US011219247B2

(12) United States Patent
Kasvikis

(10) Patent No.: US 11,219,247 B2
(45) Date of Patent: Jan. 11, 2022

(54) SUPPORT GARMENT

(71) Applicant: BEHAVE, INC., Wilmington, DE (US)

(72) Inventor: Athena Kasvikis, Foxborough, MA (US)

(73) Assignee: Behave, Inc., Wilmington, DE (US)

( * ) Notice: Subject to any disclaimer, the term of this patent is extended or adjusted under 35 U.S.C. 154(b) by 0 days.

(21) Appl. No.: 17/283,221

(22) PCT Filed: May 1, 2020

(86) PCT No.: PCT/US2020/031126
§ 371 (c)(1),
(2) Date: Apr. 6, 2021

(87) PCT Pub. No.: WO2020/227129
PCT Pub. Date: Nov. 21, 2020

(65) Prior Publication Data

US 2021/0315284 A1 Oct. 14, 2021

Related U.S. Application Data

(60) Provisional application No. 62/843,167, filed on May 3, 2019.

(51) Int. Cl.
*A41C 3/00* (2006.01)

(52) U.S. Cl.
CPC ..... *A41C 3/0007* (2013.01); *A41C 3/0028* (2013.01)

(58) Field of Classification Search
CPC ..... A41C 3/0028; A41C 3/0007; A41C 3/122; A41C 3/124; A41C 3/10; A41C 3/14; A41C 3/142; A41C 3/0035
(Continued)

(56) References Cited

U.S. PATENT DOCUMENTS 2,067,354 A * 1/1937 Spare ..... A41C 3/0021 450/59
2,092,390 A * 9/1937 Federico ..... A41C 3/0021 450/65

(Continued)

FOREIGN PATENT DOCUMENTS

CN 201192074 Y 2/2009
WO WO-2009/149529 A1 12/2009

OTHER PUBLICATIONS

International Search Report and Written Opinion for International Application No. PCT/US2020/031126, dated Jul. 15, 2020 (12 pages).

(Continued)

*Primary Examiner* — Gloria M Hale
(74) *Attorney, Agent, or Firm* — Clark & Elbing LLP

(57) ABSTRACT

Described herein is a breast support garment and methods of use thereof. The garment can be used by a wearer with a small band size and a fuller bust and may be worn during leisure or sleep. The garment contains a sleep stay attached to an inside surface of the front section of the garment (e.g., within each cup) that can be stretched to enwrap the inner curve of a wearer's breast, thereby providing stabilization, physical separation, and/or vertical and/or horizontal support for the wearer's breast (e.g., to counter the pull of gravity on the breasts when a wearer is reclining or sleeping, e.g., side-sleeping, and/or to reduce the movement of the breasts when a wearer is changing positions or carrying out daily activities (e.g., walking)).

48 Claims, 12 Drawing Sheets

(58) Field of Classification Search
USPC ..... 450/59, 60, 87, 52, 61–63
See application file for complete search history.

(56) References Cited

U.S. PATENT DOCUMENTS

| | | | | | |
|---|---|---|---|---|---|
| 2,100,890 | A * | 11/1937 | Witkower | A41C 3/00 | 450/62 |
| 2,175,676 | A * | 10/1939 | Walters | A41C 3/0021 | 450/63 |
| 2,246,826 | A * | 6/1941 | Witkower | A41C 3/0021 | 450/59 |
| 2,421,448 | A * | 6/1947 | Witkower | A41C 3/0021 | 450/63 |
| 2,484,440 | A * | 10/1949 | Witkower | A41C 3/0021 | 450/59 |
| 2,523,715 | A * | 9/1950 | Panes | A41C 3/00 | 450/60 |
| 2,530,829 | A * | 11/1950 | Licht | A41C 3/08 | 450/52 |
| 2,592,792 | A * | 4/1952 | Cohen | A41C 3/0021 | 450/63 |
| 2,624,049 | A | 1/1953 | Granne | | |
| 2,688,749 | A * | 9/1954 | Cocks | A41F 1/006 | 450/83 |
| 2,734,193 | A * | 2/1956 | Croxall | A41C 3/0021 | 450/63 |
| 4,955,846 | A | 9/1990 | Greenberg | | |
| 6,102,772 | A | 8/2000 | Fernandez | | |
| 6,769,955 | B1 | 8/2004 | Fisher | | |
| 8,016,640 | B2 | 9/2011 | Morgan | | |
| 8,177,602 | B1 * | 5/2012 | Kaytes | A41C 3/0028 | 450/60 |
| 8,568,196 | B2 * | 10/2013 | Haworth | A41C 3/0021 | 450/60 |
| 8,585,458 | B2 | 11/2013 | Armanino | | |
| 8,708,772 | B2 | 4/2014 | Fernandez Cuevas | | |
| 2005/0277364 | A1 | 12/2005 | Redenius | | |
| 2009/0061731 | A1 * | 3/2009 | Redenius | A41C 3/0021 | 450/39 |
| 2011/0201251 | A1 | 8/2011 | de Sousa et al. | | |
| 2012/0276811 | A1 | 11/2012 | Nakajima et al. | | |
| 2012/0302135 | A1 * | 11/2012 | Solotoff | A41C 3/0007 | 450/52 |
| 2014/0295735 | A1 | 10/2014 | Hagmann | | |
| 2017/0226691 | A1 | 8/2017 | Farmer et al. | | |

OTHER PUBLICATIONS

Elliot, "Can this nighttime contraption keep your breasts perky? Plastic surgeon invents 'sleep bra' which prevents sagging and wrinkles," Mail Online. (2014).

* cited by examiner

SUPPORT GARMENT

BACKGROUND OF THE INVENTION

The task of finding a comfortable, supportive bra is challenging for most women, but it is particularly difficult for women with large, full busts. The bra size 38D is the largest size manufactured by many brands, making it difficult for women with smaller band sizes (e.g., a band size of 30-38) and fuller busts (e.g., a DD cup or larger) to find bras sized to fit their bodies. Moreover, standard bras for day-to-day wear are designed to support breasts while the wearer is standing or sitting upright. Most of the support comes from the band and/or the strap, which may lead to neck, shoulder, and back pain in women with fuller busts, especially those who cannot find a bra that fits properly. In addition, such bras may not sufficiently stabilize the breasts of women with fuller busts, leading to unwanted breast movement during daily wear (e.g., while walking or moving during the course of the day). Women with fuller busts may also wish to wear bras while sleeping to keep their breasts separated and reduce the discomfort, sagging, and wrinkling that may result from the effect of gravity on breast tissue while sleeping (e.g., side sleeping). However, a bra worn during sleep must be able to prevent or reduce sideways motion of the breasts so that the breasts are not pulled toward the bed and/or pressed together by gravity during sleep (e.g., side sleeping). Given that standard bras are primarily designed to reduce vertical (e.g., up-and-down) rather than horizontal (side-to-side) motion of the breasts, women with fuller busts may need different bras to wear during the day and while sleeping. There exists a need for a bra that can provide both vertical and horizontal support for women with large, full busts regardless of body positioning.

SUMMARY OF THE INVENTION

The present invention provides a garment (e.g., a bra) for women with smaller band sizes and fuller busts (e.g., a band size of 28 to 38 and a cup size of DD to I) that is suitable for wear during the day and/or night (e.g., for leisure and/or sleep). The garment contains a sleep stay within the front section of the garment (e.g., within each cup of the garment) that can be stretched to enwrap the inner curve of a breast of a wearer to stabilize and/or provide containment of breast tissue (e.g., for a wearer that is moving between different positions or moving in the course of daily activities), to physically separate the breasts, and/or to provide horizontal and/or vertical support for a breast (e.g., to reduce sideways movement of the breasts of a wearer during sleep).

In a first aspect, the invention features a breast support garment including a) a front section having inside and outside surfaces and top and bottom edges and containing: i) left and right cups, each said cup having an area configured to receive a breast of a wearer, and/or ii) a front band configured to span a length of the front section and to rest against a wearer's torso below the wearer's breasts; b) i) at least two straps, each of which is connected to a top (e.g., a top of an inside surface) of a respective cup on the front section of the garment or at the top edge (e.g., at the top edge of the inside surface) of the front section of the garment; or ii) a single strap having first and second ends each of which is connected to a top (e.g., a top of an inside surface) of a respective cup on the front section of the garment or to the top edge (e.g., the top edge of the inside surface) of the front section of the garment; and c) a movable sleep stay for each respective breast positioned inside the front section of the garment, in which each said sleep stay includes at least a first lower end attached along a bottom edge of an inside surface of the cup or along a portion of an inside surface of the front band that is configured to be positioned below a breast of a wearer and a second upper end attached near a top of an inside surface of the cup or along a portion of the respective strap, and in which each said sleep stay can be moved between an engaged position and a disengaged position. In some embodiments, the front band includes elastic. In some embodiments, the garment further includes a back section connected to the front section and containing at least one layer of fabric that is configured to span a wearer's back. In some embodiments, each of said straps is connected at a first end to the top of a respective cup on the front section of the garment or to the top edge of the front section of the garment and at a second end along the back section. In some embodiments, the first lower end of each said sleep stay is attached at a single point along the bottom edge the inside surface of the cup or at a single point along a portion of the inside surface of the front band that is configured to be positioned below the breast of a wearer. In some embodiments, the first lower end of each said sleep stay is attached at or near a central point along the bottom edge of the inside surface of the cup (e.g., at the center of the bottom edge of the inside surface of the cup or 0.25, 0.5, 0.75, 1.0, 1.25, 1.5, 1.75, or 2.0 inches to the left or the right of the center of the bottom edge of the inside surface of the cup) or along a portion of the inside surface of the front band that is configured to be positioned at or near a center point below the breast of a wearer (e.g., at the center point below the breast of a wearer or 0.25, 0.5, 0.75, 1.0, 1.25, 1.5, 1.75, or 2.0 inches to the left or the right of the center point below the breast of a wearer).

In some embodiments, the garment includes a) a front section having inside and outside surfaces and top and bottom edges and including left and right cups, each said cup having an area to receive a breast of a wearer, and a back section connected to the front section and containing at least one layer of fabric that is configured to span a wearer's back; b) i) at least two straps, each of which is connected at a first end to a top (e.g., a top of an inside surface) of a respective cup on the front section of the garment and at a second end along the back section; or ii) a single strap having first and second ends each of which is connected to a top (e.g., a top of an inside surface) of a respective cup; and c) a movable sleep stay for each respective breast positioned inside each said cup, in which each said sleep stay includes at least a first lower end attached along a bottom edge of an inside surface of the cup and a second upper end attached near the top of an inside surface of the cup or along a portion of the respective strap, and in which each said sleep stay can be moved between an engaged position and a disengaged position.

In another aspect, the invention features a breast support garment including a) a front section having inside and outside surfaces and top and bottom edges, wherein the front section is configured to fit tightly against the chest of a wearer; and b) a movable sleep stay for each respective breast positioned inside the front section of the garment, wherein each said sleep stay comprises at least a first lower end attached along a portion of an inside surface of the front section that is configured to be positioned below a breast of a wearer and a second upper end attached along a portion of an inside surface of the front section that is configured to be positioned above a breast of the wearer, and wherein each said sleep stay can be moved between an engaged position and a disengaged position. In some embodiments, the garment further includes a back section. In some embodiments, the first lower end of each said sleep stay is attached at a single point along a portion of the inside surface of the front section that is configured to be positioned below the breast of a wearer. In some embodiments, the first lower end of each said sleep stay is attached along a portion of the inside surface of the front section that is configured to be positioned at or near a center point below the breast of a wearer (e.g., at the center point below the breast of a wearer or 0.25, 0.5, 0.75, 1.0, 1.25, 1.5, 1.75, or 2.0 inches to the left or the right of the center point below the breast of a wearer). In some embodiments, the second upper end of each said sleep stay is attached at a single point along a portion of the inside surface of the front section that is configured to be positioned above the breast of a wearer. In some embodiments, the second upper end of each said sleep stay is attached along a portion of the inside surface of the front section that is about 0.5 inches to about 4 inches from a portion of the garment (e.g., a portion of the front section) that is configured to rest on a collarbone of a wearer (e.g., 0.5, 1.0, 1.5, 2.0, 2.5, 3.0, 3.5, or 4.0 inches above or below the portion of the garment (e.g., the front section) that is configured to rest on the collarbone of a wearer). In some embodiments, the second upper end of each said sleep stay is attached along a portion of the inside surface of the front section that is about 1 inch to about 2 inches from a portion of the garment (e.g., a portion of the front section) that is configured to rest on a collarbone of a wearer (e.g., about 1 inch to about 2 inches below the portion of the garment (e.g., the front section) that is configured to rest on the wearer's collarbone). In some embodiments, the garment further includes one or more of i) left and right cups, each said cup having an area configured to receive a breast of a wearer, ii) a front band configured to span a length of the front section and to rest against a wearer's torso below the wearer's breasts; and iii) a) at least two straps, each of which is connected to a top (e.g., a top of an inside surface) of a respective cup on the front section of the garment or at the top edge (e.g., at the top edge of the inside surface) of the front section of the garment; or b) a single strap having first and second ends each of which is connected to a top (e.g., a top of an inside surface) of a respective cup on the front section of the garment or to the top edge (e.g., the top edge of the inside surface) of the front section of the garment.

In another aspect, the invention features a breast support garment including: a) a front section including left and right cups, each said cup having an area to receive a breast of a wearer, and a back section connected to the front section and including at least one layer of fabric that is configured to span a wearer's back; b) at least two straps, each of which is connected at a first end to a top (e.g., a top of an inside surface) of a respective cup on the front section of the garment and at a second end along the back section; or a single strap connected at each end to a top (e.g., a top of an inside surface) of a respective cup; and c) a movable sleep stay inside each cup, in which each said sleep stay includes at least a first lower end attached along a bottom edge of an inside surface of the cup and a second upper end attached near the top of an inside surface of the cup or along a portion the respective strap, and in which each said sleep stay can be moved between an engaged position and a disengaged position.

In some embodiments of any of the above aspects, the first lower end of each said sleep stay is attached at a single point along the bottom edge of the inside surface of the cup.

In some embodiments of any of the above aspects, the first lower end of each said sleep stay is attached at or near a central point along the bottom edge of the inside surface of the cup (e.g., at the center of the bottom edge of the inside surface of the cup or 0.25, 0.5, 0.75, 1.0, 1.25, 1.5, 1.75, or 2.0 inches to the left or the right of the center of the bottom edge of the inside surface of the cup).

In some embodiments of any of the above aspects, the sleep stay can be contained within the front section or the cup (e.g., contained within the cup) or stretched to enwrap an inner curve of a breast of a wearer.

In some embodiments of any of the above aspects, each said sleep stay includes a first edge defined by a straight or arcuate line between the second upper end and the first lower end of the sleep stay, in which the first edge is configured to be oriented toward a center of the garment, and a second edge defined by a straight or arcuate line between the second upper end and the first lower end of the sleep stay, in which the second edge is configured to be oriented toward a side of the garment. In some embodiments, the first edge is configured to enwrap an inner curve of a breast of a wearer. In some embodiments, the first edge is straight and/or the second edge is arcuate. In some embodiments, a length of the first edge and a length of the second edge have a ratio of approximately 1:1.25 to 1:4 (e.g., 1:1.25, 1:1.5, 1:1.75, 1:2, 1:2.25, 1:2.5, 1:2.75, 1:3, 1:3.25, 1:3.5, 1:3.75, or 1:4). In some embodiments, the length of the first edge and the length of the second edge have a ratio of approximately 1:2. In some embodiments, the first edge is straight and/or the second edge is straight. In some embodiments, the first edge is arcuate and/or the second edge is arcuate.

In some embodiments of any of the above aspects, each said sleep stay further includes a third end attached along an edge of the inside surface of the cup that is configured to rest on or near a center of a wearer's chest during wear (e.g., the edge of the cup that forms one side of the "V" at the center of the garment), attached along a portion of the inside surface of the front band that is configured to be positioned below a breast of a wearer, or attached along a portion of the inside surface of the front section that is configured to rest on or near a center of a wearer's chest during wear, in which each said sleep stay includes a first edge defined by a straight or arcuate line between the second upper end and the first lower end of the sleep stay, in which the first edge is configured to be oriented toward a side of the garment, a second edge defined by a straight or arcuate line between the first lower end and the third end of the sleep stay, in which the second edge is configured to be oriented toward a center of the garment (e.g., toward a center of the front section), and a third edge defined by a straight or arcuate line between the second upper end and the third end of the sleep stay, in which the third edge is configured to be oriented toward the edge of the cup that is configured to rest on or near the center of a wearer's chest during wear (e.g., the edge of the cup that forms one side of the "V" at the center of the garment), toward the front band, or toward a center of the garment (e.g., toward a center of the front section). In some embodiments, the third end is attached along an edge of the inside surface of the cup that is configured to rest on or near the center of a wearer's chest during wear (e.g., the edge of the cup that forms one side of the "V" at the center of the garment), in which each said sleep stay includes a first edge defined by a straight or arcuate line between the second upper end and the first lower end of the sleep stay, in which the first edge is configured to be oriented toward a side of the garment, a second edge defined by a straight or arcuate line between the first lower end and the third end of the sleep stay, in which the second edge is configured to be oriented toward a center of the garment (e.g., toward a center of the front section), and a third edge defined by a straight or arcuate line between the second upper end and the third end of the sleep stay, in which the third edge is configured to be oriented toward the edge of the cup that is configured to rest on or near the center of a wearer's chest during wear (e.g., the edge of the cup that forms one side of the "V" at the center of the garment). In some embodiments, the first edge is configured to enwrap an inner curve of the breast of a wearer. In some embodiments, the first edge is straight and/or the second edge is arcuate. In some embodiments, a length of the first edge and a combined length of the second edge and third edge have a ratio of approximately 1:1.25 to 1:4 (e.g., 1:1.25, 1:1.5, 1:1.75, 1:2, 1:2.25, 1:2.5, 1:2.75, 1:3, 1:3.25, 1:3.5, 1:3.75, or 1:4). In some embodiments, the length of the first edge and the combined length of the second edge and third edge have a ratio of approximately 1:2. In some embodiments, one third, one half, two thirds, three quarters or more of a length of the third edge is attached along an edge of the inside surface of the cup that is configured to rest on or near the center of a wearer's chest during wear, attached to a portion of the inside surface of the front band that is configured to be positioned below the breast of a wearer, or attached to a portion of the inside surface of the front section that is configured to rest on or near the center of a wearer's chest during wear. In some embodiments, one third, one half, two thirds, three quarters or more of the length of the third edge is attached along the edge of the inside surface of the cup that is configured to rest on or near the center of a wearer's chest during wear. In some embodiments, all of the length of the third edge is attached along the edge of the inside surface of the cup that is configured to rest on or near the center of a wearer's chest during wear. In some embodiments, the third edge is attached along the entire length of the edge of the inside surface of the cup that is configured to rest on or near the center of a wearer's chest during wear.

In some embodiments of any of the above aspects, the garment further includes a sling inside the front section or inside each cup that is configured to provide additional vertical support to a breast of a wearer. In some embodiments, each said sling includes a first lower end attached along the bottom edge of the inside surface of each said cup, along the portion of the inside surface of the front band that is configured to be positioned below a breast of a wearer, or along the portion of the inside surface of the front section that is configured to be positioned below a breast of a wearer, and a second upper end attached along on an edge of the inside surface of each said cup that is configured to rest near an underarm of a wearer or along an edge of an the inside surface of the front section that is configured to rest near an underarm of a wearer. In some embodiments, each said sling includes a first lower end attached along the bottom edge of the inside surface of each said cup and a second upper end attached along the edge of the inside surface of each said cup that is configured to rest near the underarm of a wearer. In some embodiments, the first lower end of each said sling is attached at or near a central point along the bottom edge of the inside surface of each said cup (e.g., at the center of the bottom edge of the inside surface of the cup or 0.25, 0.5, 0.75, 1.0, 1.25, 1.5, 1.75, or 2.0 inches to the left or the right of the center of the bottom edge of the inside surface of the cup), along a portion of the inside surface of the front band that is configured to be positioned at or near the center point below the breast of a wearer (e.g., at the center point below the breast of a wearer or 0.25, 0.5, 0.75, 1.0, 1.25, 1.5, 1.75, or 2.0 inches to the left or the right of the center point below the breast of a wearer), or along a portion of the inside surface of the front section that is configured to be positioned at or near the center point below the breast of a wearer (e.g., at the center point below the breast of a wearer or 0.25, 0.5, 0.75, 1.0, 1.25, 1.5, 1.75, or 2.0 inches to the left or the right of the center point below the breast of a wearer). In some embodiments, the first lower end of each said sling is attached at a central point along the bottom edge of the inside surface of each said cup. In some embodiments, the first lower end of each said sling is attached at a single point along the bottom edge of the inside surface of each said cup. In some embodiments, the second upper end of each said sling is attached at a single point along the edge of the inside surface of each said cup that is configured to rest near the underarm of a wearer.

In some embodiments of any of the above aspects, the front section further includes a front band.

In some embodiments of any of the above aspects, the sleep stay includes a knit and/or elastomeric fabric (e.g., cotton, nylon, polyester, spandex (elastane), lace, silk, stretch silk charmeuse, rayon, tricot, raschel, mesh, power mesh, jersey, rubber fabric, lastol, neoprene, or a blend, such as a nylon/spandex blend). In some embodiments, the sleep stay includes a stretch knit fabric.

In some embodiments of any of the above aspects, the sleep stay includes mesh, power mesh, or jersey fabric.

In some embodiments of any of the above aspects, the sleep stay includes compression fabric.

In some embodiments of any of the above aspects, the front section includes one or more layers of fabric (e.g., 1, 2, 3, 4, or more layers of fabric)

In some embodiments of any of the above aspects, the front section includes two or more layers of fabric (e.g., 2, 3, 4, 5, or more layers of fabric).

In some embodiments of any of the above aspects, the back section includes one or more layers of fabric (e.g., 1, 2, 3, 4, or more layers of fabric)

In some embodiments of any of the above aspects, the back section includes two or more layers of fabric (e.g., 2, 3, 4, 5, or more layers of fabric).

In some embodiments of any of the above aspects, the sleep stay includes a type (e.g., material), color, or pattern of fabric that is different from the type (e.g., material), color, or pattern of fabric of the front section, back section, and/or strap of the garment.

In some embodiments of any of the above aspects, the sleep stay includes a type (e.g., material), color, or pattern of fabric that is the same as the type (e.g., material), color, or pattern of fabric of the front section, back section, and/or strap of the garment.

In some embodiments of any of the above aspects, the second upper end of each said sleep stay is attached to the respective strap at any position along the strap between a point of attachment to the top of the cup or the top of the front section and a portion of the strap that is configured to rest on the shoulder of a wearer.

In some embodiments of any of the above aspects, the second upper end of each said sleep stay is attached to the respective strap at a position that is about 0.5 inches to about 4.0 inches from the point of said strap that is configured to rest on the collarbone of a wearer (e.g., 0.5, 1.0, 1.5, 2.0, 2.5, 3.0, 3.5, or 4.0 inches above or below the portion of the strap that is configured to rest on the collarbone of a wearer).

In some embodiments, the second upper end of each said sleep stay is attached to the respective strap at a position that is about 1 inch to about 2 inches from the point of said strap that is configured to rest on the collarbone of a wearer (e.g., about 1 inch to about 2 inches above or below the portion of the strap that is configured to rest on the wearer's collarbone).

In some embodiments of any of the above aspects, the second upper end of each said sleep stay is attached along an underside of the respective strap.

In some embodiments of any of the above aspects, the sleep stay includes a pattern. In some embodiments, the pattern is on a front-facing side of the sleep stay (e.g., the side that is configured to face away from the body of a wearer).

In some embodiments of any of the above aspects, each said sleep stay is configured to provide vertical and horizontal support to the respective breast of the wearer.

In some embodiments of any of the above aspects, an edge of each said sleep stay (e.g., the first edge) includes an elastomeric material (e.g., includes elastic).

In some embodiments of any of the above aspects, each said sleep stay further includes a knitted edge.

In some embodiments of any of the above aspects, each said sleep stay further includes a movable seam for modification of the length and/or position of the sleep stay in the garment.

In some embodiments of any of the above aspects, each said sleep stay is about 0.5 inches to about 4.0 inches wide (e.g., 0.5, 0.75, 1.0, 1.25, 1.5, 1.75, 2.0, 2.25, 2.5, 2.75, 3.0, 3.25, 3.5, 3.75, or 4.0 inches wide).

In some embodiments of any of the above aspects, the garment is sized to fit a band size of about 28 to about 38 and a cup size of DD or larger of the wearer.

In some embodiments of any of the above aspects, the strap(s) is padded.

In some embodiments of any of the above aspects, the garment further includes an underarm side panel on each side of the garment. In some embodiments, the underarm side panel is double-reinforced.

In some embodiments of any of the above aspects, the front section includes an outer layer of fabric and an inner layer of fabric. In some embodiments, the outer layer of fabric is a lace fabric and the inner layer of fabric is a mesh fabric. In some embodiments, the inner layer of fabric is darted in each said cup or in a position of the front section of the garment configured to receive each said breast.

In some embodiments of any of the above aspects, the front section further includes elastic lining one or more edges of the inside surface of the front section or the inside surface of each said cup.

In some embodiments of any of the above aspects, the front section further includes elastic positioned between the outer layer of fabric and the inner layer of fabric along a center seam configured to be positioned between the breasts of a wearer (e.g., a long a center seam between the cups).

In some embodiments of any of the above aspects, the back section includes a single layer of fabric. In some embodiments, the back section includes a lace fabric.

In some embodiments of any of the above aspects, each strap is connected at the second end to the one or more layer(s) of fabric on the back section of the garment.

In some embodiments of any of the above aspects, each strap is connected at the second end to an X-shaped piece of fabric that is attached to the back section of the garment.

In some embodiments of any of the above aspects, the garment includes said single strap having first and second ends each of which is connected to a top of a respective cup or to the top edge of the front section of the garment, and in which the strap does not connect to the back section of the garment.

In some embodiments of any of the above aspects, the strap(s) is adjustable.

In some embodiments of any of the above aspects, the strap(s) is detachable.

In some embodiments of any of the above aspects, the garment does not contain underwire.

In some embodiments of any of the above aspects, the garment does not contain metal components.

In some embodiments of any of the above aspects, the garment does not contain plastic components.

In some embodiments of any of the above aspects, the garment does not include a front closure and/or a back closure.

In some embodiments of any of the above aspects, the garment includes an elastic band that spans the length of an inside surface front section of the garment and an inside surface of the back section of the garment and is configured to encircle a torso of the wearer.

In some embodiments of any of the above aspects, the garment includes flat-lock stitching along one or more seams thereof.

In some embodiments of any of the above aspects, each said sleep stay does not provide support for a breast of a wearer when the sleep stay is in the disengaged position.

In some embodiments of any of the above aspects, each said sleep stay is not visible from the exterior of the garment when the sleep stay is in the disengaged position.

In some embodiments of any of the above aspects, each said sleep stay provides vertical and/or horizontal support for a breast of a wearer when the sleep stay is in the engaged position.

In some embodiments of any of the above aspects, each said sleep stay is stretched to enwrap the inner curve of the breast of a wearer when the sleep stay is in the engaged position.

In some embodiments of any of the above aspects, each said sleep stay is visible from the exterior of the garment when the sleep stay is in the engaged position.

In some embodiments of any of the above aspects, the garment is a bra.

In some embodiments of any of the above aspects, the garment is a swimsuit. In some embodiments, the garment is a one-piece swimsuit. In some embodiments, the garment is a two-piece swimsuit.

In some embodiments of any of the above aspects, the garment is shapewear.

In some embodiments of any of the above aspects, the garment is sleepwear. In some embodiments, the sleepwear is a nightie, a nightgown, or a pajama tank top.

In some embodiments of any of the above aspects, the garment is a shirt (e.g., a T-shirt).

In some embodiments of any of the above aspects, the garment is activewear.

In another aspect, the invention features a method of reducing or inhibiting movement of a breast of a subject by clothing the subject in a breast support garment of the invention and enwrapping the inner curve of the breast with said sleep stay.

In another aspect, the invention features a method of stabilizing a breast of a subject by clothing the subject in a breast support garment of the invention and enwrapping the inner curve of the breast with said sleep stay.

In another aspect, the invention features a method of physically separating a subject's breasts by clothing the subject in a breast support garment of the invention and enwrapping the inner curve of each breast with each said sleep stay.

In some embodiments of any of the above aspects, the method reduces or inhibits movement of the breast during sleep.

In some embodiments of any of the above aspects, the sleep stay reduces or inhibits movement of the breast during sleep.

In some embodiments of any of the above aspects, the method reduces or inhibits vertical (up-and-down) and/or horizontal (side-to-side) movement of the breast.

In some embodiments of any of the above aspects, the sleep stay reduces or inhibits vertical (up-and-down) and/or horizontal (side-to-side) movement of the breast.

In some embodiments of any of the above aspects, the sleep stay contains the breast when the subject moves between different positions or moves (e.g., walks) during the course of daily activities.

In some embodiments of any of the above aspects, the method reduces the formation of chest wrinkles.

In some embodiments of any of the above aspects, the garment (e.g., the sleep stay) reduces the formation of chest wrinkles.

In some embodiments of any of the above aspects, the method reduces breast sagging.

In some embodiments of any of the above aspects, the garment (e.g., the sleep stay) reduces breast sagging.

In some embodiments of any of the above aspects, the method reduces pain or discomfort associated with breast movement or breast size.

In some embodiments of any of the above aspects, the garment (e.g., the sleep stay) reduces pain or discomfort associated with breast movement or breast size.

In another aspect, the invention features a method of reducing post-surgical breast pain or discomfort in a subject by clothing the subject in a breast support garment of the invention.

In another aspect, the invention features a method of supporting a breast of a subject with sensitive skin by clothing the subject in a breast support garment of the invention.

In another aspect, the invention features a method of supporting a breast of a pregnant subject by clothing the subject in a breast support garment of the invention.

In another aspect, the invention features a use of a breast support garment of the invention for reducing or inhibiting breast movement in a subject.

In another aspect, the invention features a use of a breast support garment of the invention for stabilizing a subject's breasts.

In another aspect, the invention features a use of a breast support garment of the invention for physically separating a subject's breasts.

In some embodiments of any of the above aspects, the use includes enwrapping the inner curve of each of the subject's breasts with said sleep stay.

In some embodiments of any of the above aspects, the use reduces or inhibits breast movement during sleep.

In some embodiments of any of the above aspects, the garment (e.g., the sleep stay) reduces or inhibits breast movement during sleep.

In some embodiments of any of the above aspects, the use reduces or inhibits vertical (up-and-down) and/or horizontal (side-to-side) movement of the breast.

In some embodiments of any of the above aspects, the garment (e.g., the sleep stay) reduces or inhibits vertical (up-and-down) and/or horizontal (side-to-side) movement of the breast.

In some embodiments of any of the above aspects, the garment (e.g., the sleep stay) contains the breast when the subject moves between different positions or moves (e.g., walks) during the course of daily activities.

In some embodiments of any of the above aspects, the use reduces the formation of chest wrinkles.

In some embodiments of any of the above aspects, the use reduces breast sagging.

In some embodiments of any of the above aspects, the use reduces pain or discomfort associated with breast movement or breast size.

In some embodiments of any of the above aspects, the garment (e.g., the sleep stay) reduces the formation of chest wrinkles.

In some embodiments of any of the above aspects, the garment (e.g., the sleep stay) reduces breast sagging.

In some embodiments of any of the above aspects, the garment (e.g., the sleep stay) reduces pain or discomfort associated with breast movement or breast size.

In some embodiments of any of the above aspects, the subject is pregnant.

In some embodiments of any of the above aspects, the subject is nursing.

In some embodiments of any of the above aspects, the subject is recovering from breast surgery.

In some embodiments of any of the above aspects, the subject has sensitive skin.

In another aspect, the invention features a use of a breast support garment of the invention for reducing post-surgical breast pain or discomfort in a subject.

In another aspect, the invention features a use of a breast support garment of the invention for supporting a breast of a subject with sensitive skin.

In another aspect, the invention features a use of a breast support garment of the invention for supporting a breast of a pregnant subject.

In some embodiments of any of the above aspects, the subject is a subject with a band size of about 28 to about 38 and a cup size of DD or larger.

BRIEF DESCRIPTION OF THE DRAWINGS

FIG. 1A is a back view of breast support garment (100) that includes strap (102), sleep stay (104), inner cup (106), back section (108), and elastic (110) lining the edges of inner cup (106). Sleep stay (104) rests within inner cup (106) when disengaged (e.g., when not engaged to stabilize and/or separate breast tissue and/or provide support to a breast). Back section (108) may be made of a single layer of fabric, such as lace (e.g., stretch lace), inner cup (106) may be made of mesh, sleep stay (104) may be made of a knit and/or elastomeric fabric (e.g., a stretch knit) or a compression blend, and elastic (110) may be a plush elastic (e.g., lingerie elastic). Strap (102) may include adjuster (111) that allows the length of strap (102) to be modified. FIG. 1B is a back view of breast support garment (100) on a wearer, in which strap (102) and back section (108) are visible. Strap (102) may be adjusted using adjuster (111).

FIG. 2A is a bottom view of breast support garment (100) that includes strap (102), sleep stay (104), inner cup (106), elastic (110) lining the outer edge of inner cup (106), front section (112), back section (108), and outer cup (114). Sleep stay (104) rests within inner cup (106) when disengaged (e.g., when not engaged to stabilize and/or separate breast tissue and/or provide support to a breast), and may not extend beyond center-facing edge (132) of outer cup (114) (e.g., the edge of outer cup (114) and inner cup (106) that forms one side of the "V" at the center of front section (112) and is configured to rest on or near the center of a wearer's chest). Inner cup (106) may be made of mesh, outer cup (114) may be made of lace (e.g., stretch lace), sleep stay (104) may be made of a knit and/or elastomeric fabric (e.g., a stretch knit) or a compression blend, and elastic (110) may be a plush elastic (e.g., lingerie elastic). Strap (102) may include adjuster (111) that allows the length of strap (102) to be modified. Sleep stay (104) may be made of a fabric that is the same type (e.g., material), color, and/or pattern as the fabric of front section (112), or of a fabric that is a different type (e.g., material), color, and/or pattern than the fabric of front section (112). In embodiments in which front section (112) is made of a single layer of fabric, outer cup (114) is formed by the outer side of the fabric and inner cup (106) is formed by the inner side of the fabric. FIG. 2B is a bottom view of breast support garment (100) in which sleep stay (104) has been moved into an engaged position (e.g., the position of sleep stay (104) if stretched to enwrap the inner curve of a breast of a wearer). Sleep stay (104) is semi-transparent in FIG. 2B to demonstrate that sleep stay (104) may extend beyond center-facing edge (132) of outer cup (114) when sleep stay is engaged (e.g., stretched to enwrap the inner curve of a breast of a wearer). In this configuration, a portion of sleep stay (104) is visible from the exterior of breast support garment (100), and the remainder of sleep stay (104) is contained within inner cup (106). If sleep stay (104) were opaque, it would not be possible to see center-facing edge (132) of outer cup (114) in this view, given that sleep stay (104) is configured to rest against the body of a wearer, and front section (112) (e.g., inner cup (106)) is configured to rest on top of sleep stay (104).

FIG. 3A is a front view of breast support garment (100) when sleep stay (104) is disengaged that includes strap (102), front section (112), outer cup (114), seam of internal elastic (116), and front band (118). The width of front band (118) may vary with the width of the back section of breast support garment (100). As the width of front band (118) increases, it may give breast support garment (100) a longline shape, which may reduce the movement of breast support garment (100) on the torso of a wearer. Front section (112), which contains outer cup (114) and front band (118) may be made with an outermost layer of lace (e.g., stretch lace). Internal elastic (116) can be positioned beneath the outermost layer of fabric of front section (112) between cups (114), and may improve the fit and/or positioning of breast support garment (100) without being visible from the exterior. Sleep stay (104) may not be visible from the exterior of breast support garment (100) when it is disengaged. FIG. 3B is a front view of breast support garment (100) when sleep stay (104) is engaged that includes strap (102), front section (112), outer cup (114), internal elastic (116), front band (118), and sleep stay (104). Sleep stay (104) may be visible from the exterior of breast support garment (100) when engaged (e.g., when stretched to enwrap the inner curve of a breast).

FIG. 4A is a front view of breast support garment (100) on a wearer when sleep stay (104) is disengaged, in which strap (102) and front section (112) containing outer cup (114) and front band (118) are visible. Internal elastic (116) may be positioned below the outermost layer of fabric of front section (112) and between outer cups (114) to improve the fit and/or positioning of breast support garment (100) and may not be visible from the exterior of breast support garment (100). Sleep stay (104) is disengaged and is, therefore, not visible from the exterior of breast support garment (100). The width of front band (118) can vary with the width of the back section of breast support garment (100). As the width of front band (118) increases, it may give breast support garment (100) a longline shape and reduce the movement of breast support garment (100) on the torso of the wearer. Front section (112), including outer cup (114) and front band (118) may be made with an outermost layer of lace (e.g., stretch lace). FIG. 4B is a front view of breast support garment (100) on a wearer when sleep stay (104) is engaged that includes strap (102), front section (112), outer cup (114), internal elastic (116), front band (118), and sleep stay (104). Sleep stay (104) may be visible from the exterior of breast support garment (100) when engaged (e.g., when stretched to enwrap the inner curve of a breast) and may cover the breast of a wearer. In this configuration, a portion of sleep stay (104) is visible from the exterior of breast support garment (100), and the remainder of sleep stay (104) is contained within front section (112).

FIG. 6 shows an alternative means of attachment for sleep stay (104), in which top end (124) of sleep stay (104) can be attached to (e.g., sewn into) the underside of strap (102) (e.g., anywhere along the underside of strap (102) from where it is configured to contact the shoulder of a wearer to the point of connection to inner cup (106), such as about 1 to 2 inches above or below (e.g., below) the portion of strap (102) that is configured to contact the collarbone of a wearer), and third end (128) of sleep stay (104) can be attached to (e.g., sewn into) the edge of inner cup (106) that is configured to rest on or near the center of the chest of a wearer. Bottom end (126) of sleep stay (104) can be attached to (e.g., sewn into) the bottom edge of inner cup (106) (e.g., the bottom of inner cup (106) near or at the center of the bottom edge). When sleep stay (104) is attached in this manner, first edge (117) (e.g., a substantially straight edge) of sleep stay (104), defined by a line between top end (124) and bottom end (126) of sleep stay (104), can be oriented toward the side of breast support garment (100), second edge (119) (e.g., an arcuate edge) of sleep stay (104), defined by a line between bottom end (126) of sleep stay (104) and third end (128) of sleep stay (104), can be oriented toward the center of breast support garment (100), and third edge (130) of sleep stay (104), defined by a line between top end (124) of sleep stay (104) and third end (128) of sleep stay (104), can be oriented toward the edge of inner cup (106) that is configured to rest on or near the center of the chest of a wearer (e.g., the edge of inner cup (106) that forms one side of the "V" at the center of breast support garment (100)). Elastic (110) can lines the edges of inner cup (106), and elastic band (120) may be positioned below inner cup (106) at the top of front band (118) and run circumferentially along the inside of breast support garment (100). Elastic band (120) can be configured to be positioned below the breasts of a wearer when breast support garment (100) is worn. Inner cup (106) may be made of mesh and include dart (121) to improve fit. Internal elastic (116) can be positioned beneath the innermost layer of fabric of breast support garment (100) (e.g., positioned between an outer layer of lace and an inner layer of mesh) and positioned between inner cups (106) to improve the fit and/or positioning of breast support garment (100). Internal elastic (116) may not be visible from the interior of breast support garment (100). In this view, sleep stay (104) is in a disengaged position. To engage sleep stay (104), a wearer can pull first edge (117) toward the center of front section (112), which may produce a pocket-like structure to enwrap the inner curve of their breast.

FIG. 9A illustrates the attachment of sleep stay (104) to the outside (e.g., to the front surface) of strap (102). The dashed line represents the portion of sleep stay (104) that is underneath outer cup (114) of breast support garment (100). FIG. 9B illustrates the attachment of sleep stay (104) to the underside (e.g., to the inside surface) of strap (102). The dashed line represents the portion of sleep stay (104) that is underneath outer cup (114) of breast support garment (100). Strap (102) may include adjuster (111) that allows the length of strap (102) to be modified. Sleep stay (104) may be attached either to the outside or underside of strap (102).

FIG. 10A is a top view of breast support garment (100) when sleep stay is disengaged, including strap (102), back section (108), and front section (112) containing outer cup (114) and front band (118). Internal elastic (116) can be positioned below the outermost layer of fabric of front section (112) and between outer cups (114) to improve the fit and/or positioning of breast support garment (100) and may not be visible from the exterior of breast support garment (100). Sleep stay (104) is not engaged and is, therefore, contained within the interior of front section (112) (e.g., within outer cup (114)) and not visible from the exterior of breast support garment (100). Strap (102) may be adjusted using adjuster (111). Front section (112) containing outer cup (114) and front band (118) may be made of the same material or of a different material than back section (108). Front section (112) and back section (108) may both be made of lace (e.g., stretch lace). FIG. 10B is a top view of breast support garment (100) when sleep stay is in an engaged position that includes strap (102), back section (108), front section (112) containing outer cup (114) and front band (118), and sleep stay (104). Sleep stay (104) may be visible from the exterior of breast support garment (100) when engaged (e.g., when stretched to enwrap the inner curve of a breast of a wearer). In the engaged position, a portion of sleep stay (104) may visible from the exterior of breast support garment (100), and the remainder of sleep stay (104) may be contained within (e.g., hidden behind) front section (112).

As shown in FIG. 11, sleep stay (104) may attach to the underside of strap (102) and to the inside surface of the cup (e.g., to the bottom edge of the inside surface of the cup).

FIG. 12A shows breast support garment (100) containing sleep stay (104), strap (102), front section (112), back section (108), outer cup (114), and band (118), in which sleep stay (104) is in an engaged position (e.g., positioned to enwrap the inner curve of the breast of a wearer). In this position, a portion of sleep stay (104) may extend beyond center-facing edge (132) of outer cup (114) (e.g., the edge of outer cup (114) that forms one side of the "V" at the center of front section (112) and is configured to rest on or near the center of a wearer's chest) so that a portion of sleep stay (104) is visible above outer cup (114), and a portion of sleep stay (104) may be hidden behind (e.g., underneath) outer cup (114) and strap (102). The bottom edge of band (118) is shown to designate the bottom edge of breast support garment (100). FIG. 12B shows breast support garment (100) containing sleep stay (104), strap (102), front section (112), back section (108), outer cup (114), and band (118), in which sleep stay (104) is in a disengaged position (e.g., not positioned to enwrap the inner curve of the breast of a wearer). In this position, sleep stay (104) may be fully contained within front section (112) (e.g., underneath, e.g., hidden behind, outer cup (114), e.g., sleep stay (104) may rest near the outer edge of the breast of a wearer). The bottom edge of band (118) is shown to designate the bottom edge of breast support garment (100). As shown in FIGS. 12A-12B, sleep stay (104) may attach to strap (102) (e.g., to the underside of strap (102)) and to the inside surface of the cup (e.g., to the bottom edge of the inside surface of the cup).

DETAILED DESCRIPTION

Figure 11:
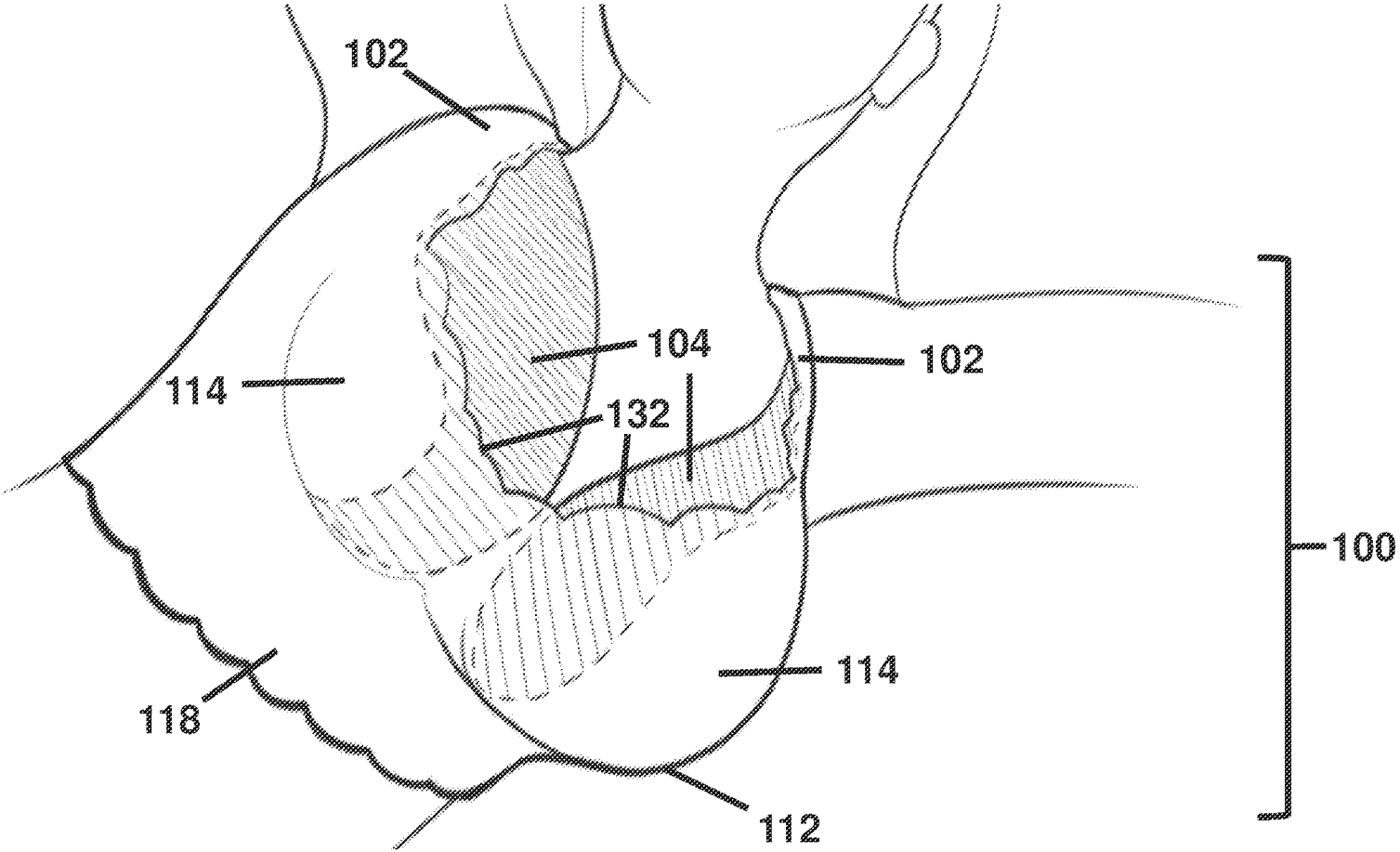
FIG. 11 is a front perspective view of breast support garment (100) shown on a wearer who is lying on her side, in which sleep stay (104), strap (102), and front section (112) containing outer cup (114) and band (118) are visible. In this view, sleep stay (104) is shown in an engaged position (e.g., enwrapping the inner curve of the breast of the wearer). In this position, sleep stay (104) may provide horizontal support to the breasts of the wearer (e.g., reduce sideways, gravity-induced motion of the breasts toward the bed), and separate the breasts (e.g., prevent the breasts from pressing together while the wearer is lying on her side). When sleep stay (104) is engaged, a portion of sleep stay (104) may extend beyond center-facing edge (132) of outer cup (114) (e.g., the edge of outer cup (114) that forms one side of the "V" at the center of front section (112) and is configured to rest on or near the center of a wearer's chest) and be visible above outer cup (114). The dashed lines represent the portion of sleep stay (104) that is hidden behind (e.g., underneath) outer cup (114) and strap (102).
Figure 12B:
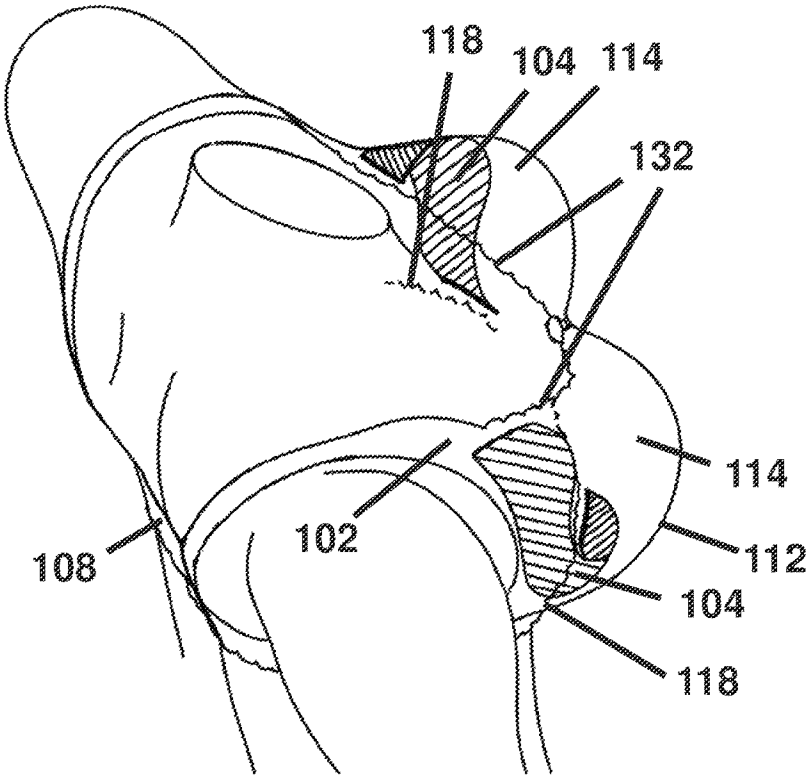
FIGS. 12A-12B are rear and right side perspective views of a torso wearing breast support garment (100).
Figure 12A:
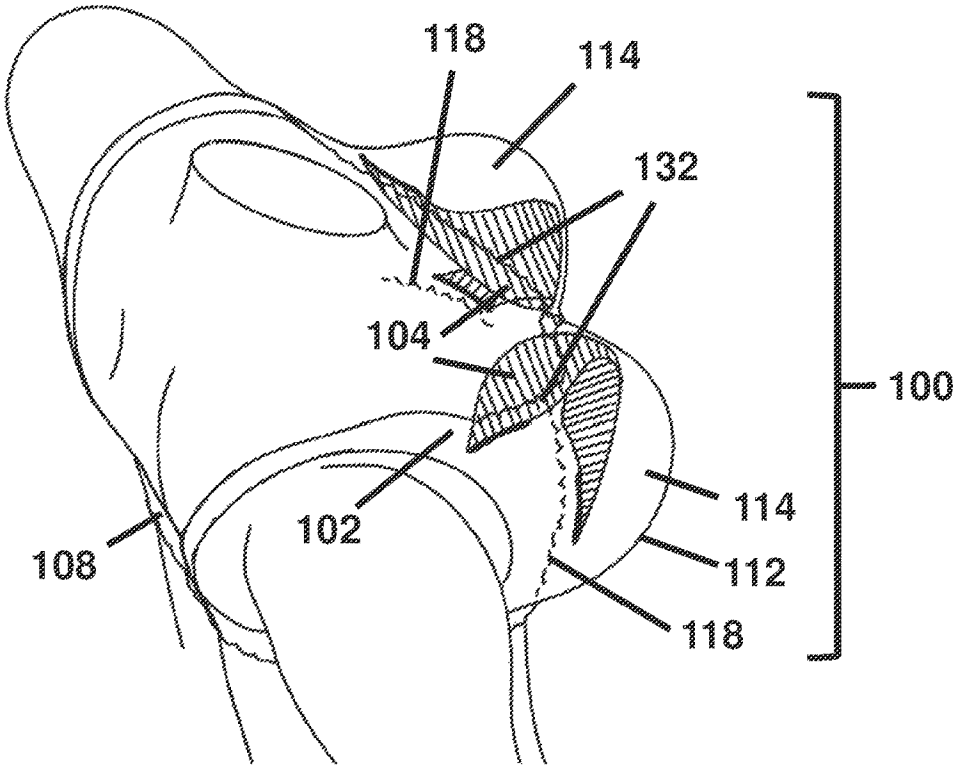

Described herein is a breast support garment configured to provide vertical and horizontal support to breasts when worn, e.g., during leisure and sleep. The garment contains material sufficient to cover each breast of a wearer. The material may be formed in the shape of a cup for each breast. The garment also has a sleep stay positioned inside the left and right side of the front section of the garment (e.g., inside each cup). The sleep stay may be made of a knit and/or elastomeric fabric (e.g., a stretch knit). The sleep stay can be secured at a first end to an inside surface of the front section of the garment that is configured to be positioned below the breast of a wearer (e.g., at a bottom interior edge (e.g., at or near the center of the bottom interior edge) of each cup) and at a second end to an inside surface of the front section of the garment that is configured to be positioned above the breast of a wearer or to a strap (e.g., to the outside or the underside of a strap). The sleep stay can be stretched to enwrap the inner curve of the breast to stabilize and/or provide containment of breast tissue (e.g., to reduce or prevent breast movement for a wearer that is moving, e.g., moving between different positions or moving in the regular course of daily activities, such as walking), to physically separate the breasts (e.g., to prevent the breasts from pressing together when a wearer is leaning to the side or lying on her side), and/or to provide both vertical and horizontal support (e.g., for a wearer during sleep or leisure activities). When the sleep stay is stretched or positioned (e.g., moved toward the center of the garment, e.g., toward the center of the chest of a wearer) to enwrap the inner curve of the breast of a wearer, it is in an engaged position (see, e.g., FIGS. 11 and 12A). When the sleep stay is not stretched to enwrap the inner curve of the breast of a wearer (e.g., when the sleep stay is contained within (e.g., hidden behind) the front section of the garment (e.g., within the cup), in which it may contact the skin of the of the breast but is not being used to separate, support, or stabilize the breast of a wearer), the sleep stay is an a disengaged position (see, e.g., FIG. 12B). The inner curve of the breast refers to the curve of the breast positioned near the center of a woman's chest, while the outer curve of the breast is positioned near the underarm. The sleep stay provides benefits for use during sleep (e.g., breast separation and a reduction in gravity-induced breast movement, such as during side sleeping), but also reduces breast movement and/or stabilizes the breast tissue of a wearer who is awake and reclining, changing positions, or moving (e.g., walking). For example, when the sleep stays are engaged, the breast support garment can reduce vertical (e.g., up-and-down) motion of the breasts when a wearer is upright and in motion, and can reduce horizontal (e.g., side-to-side) motion of the breasts when a wearer is reclining or lying down. The garment is designed such that it can fit women with fuller busts and smaller band sizes who are underserved by standard bra sizing.

Garments Containing a Sleep Stay

The garments described herein include a sleep stay for each of the wearer's breasts. The sleep stay is a piece of fabric that can provide horizontal and/or vertical support for a breast of a wearer and that is attached to the garment at two or more points, including a first point that is configured to rest below the breast of a wearer and a second point that is configured to rest above the breast of the wearer. The sleep stay includes at least one edge (e.g., 1, 2, 3, or more edges) that is not attached to the garment, which allows for the sleep stay to be moved between different positions. When the sleep stay is in a disengaged position (e.g., when the sleep stay is not being used to separate, support, or stabilize the breast of a wearer) it may be contained within (e.g., hidden behind) the front section of the garment (see, e.g., FIG. 12B). When the sleep stay is disengaged, it may not be visible from the outside of the garment, rendering the appearance of a garment containing a sleep stay no different from that of a typical garment. The sleep stay can be moved into an engaged position by wrapping an edge of the sleep stay that is not attached to the garment around the inner curve of a breast of a wearer. This action stretches or shifts the sleep stay toward the center of the front section of the garment (e.g., toward the center of the chest of a wearer) and may result in the sleep stay being visible on the chest of a wearer (e.g., may result in the sleep stay being visible from the exterior of the garment, see, e.g., FIGS. 11 and 12A). When the sleep stay is engaged, it can stabilize and/or contain the breast of a wearer, physically separate the breasts of a wearer, and/or provide vertical and/or horizontal support. The sleep stay can be incorporated into any garment that covers the breasts of a wearer, such as a bra, a swimsuit (e.g., a one-piece or two-piece swimsuit), a tank top, shapewear, sleepwear (e.g., a nightie, a nightgown, or a pajama top (e.g., a pajama tank top)), activewear, or a shirt (e.g., a T-shirt).

Features of the Sleep Stay

The sleep stay may be made of a knit and/or elastomeric fabric (e.g., cotton, nylon, polyester, spandex (elastane), lace, silk, stretch silk charmeuse, rayon, tricot, raschel, mesh, power mesh, jersey, rubber fabric, lastol, neoprene, or a blend, such as a nylon/spandex blend). In some embodiments, the sleep stay is made of a fabric that has 2-way stretch, 4-way stretch, and/or stretch on the bias. In some embodiments, the sleep stay is made of mesh, power mesh, or jersey fabric. The use of a knit and/or elastomeric fabric may provide both comfort and support for the weight of the breast. In some embodiments, the sleep stay is made of a single layer of fabric. In some embodiments, the sleep stay is made of more than one layer of fabric (e.g., 2, 3, 4, or more layers of fabric). In some embodiments, the sleep stay is made of a compression fabric, which may provide greater support for counteracting gravity during sleep for a wearer with heavier breasts. The sleep stay may be of the same color, pattern, and/or fabric as the front section of the garment, or the sleep stay may be of a different color, pattern, and/or fabric than the front section of the garment. The sleep stay may be easily visible from the exterior of the garment when stretched to enwrap the inner curve of the breast of a wearer (e.g., when in an engaged position, see, e.g., FIGS. 3B, 4B, 8, 11, and 12A), and the sleep stay may be more noticeable if it is made of a fabric that is a different color, pattern, and/or material than the front section of the garment. In some embodiments, the sleep stay is patterned (e.g., includes a print) on the front or back side (e.g., patterned on front side of the sleep stay). In some embodiments, the first edge of the sleep stay (e.g., the straight edge) may be elastomeric (e.g., include elastic). The sleep stay may further include a knitted edge with variable materials, such as mesh, power mesh, or jersey fabric. The sleep stay may also include a movable seam to allow the length and/or position of the sleep stay within the garment to be modified, if needed. The sleep stay may be about 0.5 inches to about 4.0 inches wide (e.g., 0.5, 0.75, 1.0, 1.25, 1.5, 1.75, 2.0, 2.25, 2.5, 2.75, 3.0, 3.25, 3.5, 3.75, or 4.0 inches wide).

Figure 5:
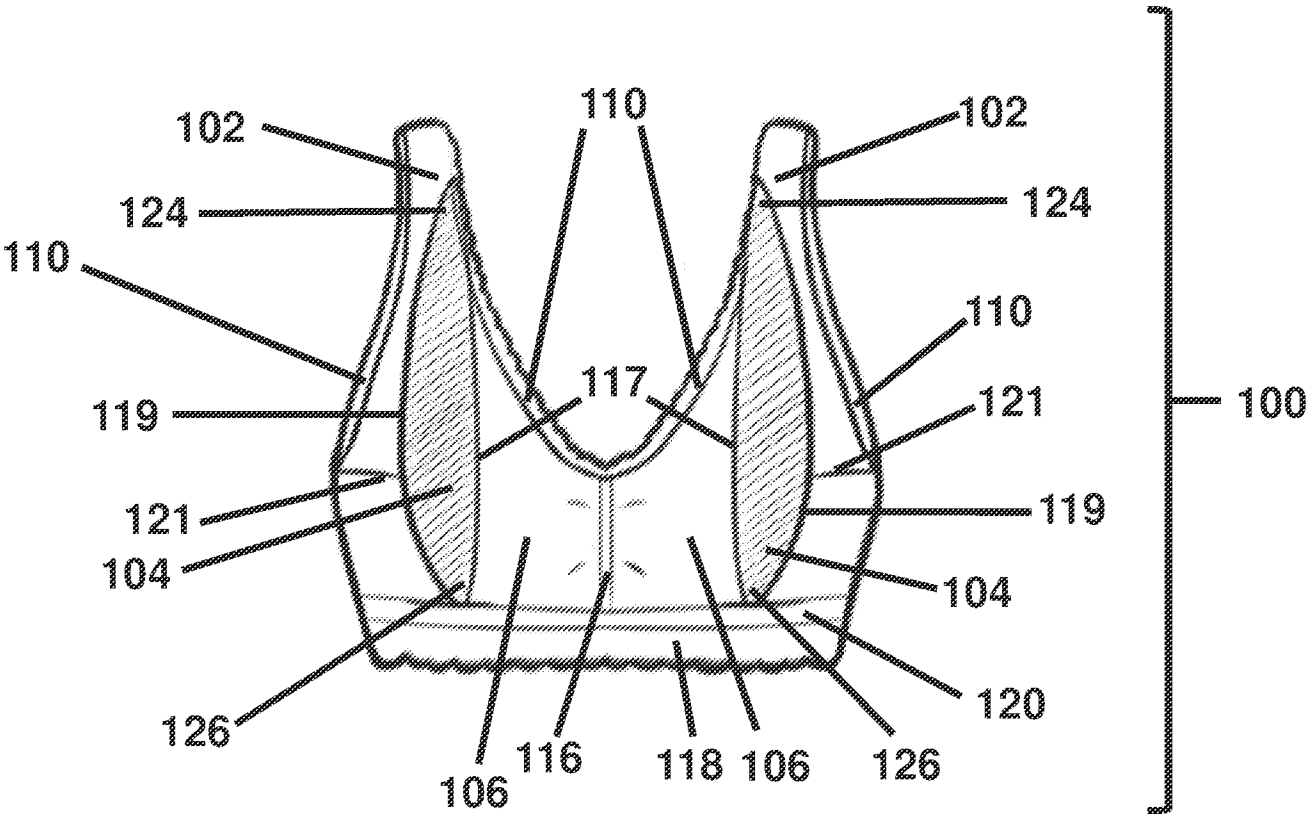
FIG. 5 is an interior view of breast support garment (100) when it is turned inside out, and includes strap (102), inner cup (106), sleep stay (104), elastic (110) lining the edges of inner cup (106), internal elastic (116), front band (118), and elastic band (120). Top end (124) of sleep stay (104) can be attached to (e.g., sewn into) the underside of strap (102) (e.g., anywhere along the underside of strap (102) from where it is configured to contact the shoulder of a wearer to the point of connection of strap (102) to inner cup (106), such as about 1 to 2 inches above or below (e.g., below) the portion of strap (102) that is configured to contact the collarbone of a wearer), and bottom end (126) of sleep stay (104) can be attached to (e.g., sewn into) the bottom edge of inner cup (106) (e.g., sewn into the bottom of inner cup (106) near or at the center of the bottom edge). When sleep stay (104) is attached in this manner, first edge (117) (e.g., a substantially straight edge) of sleep stay (104) can be oriented toward the center of breast support garment (100), and second edge (119) (e.g., an arcuate edge) of sleep stay (104) can be oriented toward the side of breast support garment (100). Elastic (110) may line the edges of inner cup (106), and elastic band (120) can be positioned below inner cup (106) at the top of front band (118) and run circumferentially along the inside of breast support garment (100). Elastic band (120) can be configured to be positioned below the breasts of a wearer when breast support garment (100) is worn. Inner cup (106) may be made of mesh and include dart (121) to improve fit. Internal elastic (116) may be positioned beneath the innermost layer of fabric of breast support garment (100) (e.g., positioned between an outer layer of lace and an inner layer of mesh) and positioned between inner cups (106) to improve the fit and/or positioning of breast support garment (100). Internal elastic (116) may not be visible from the interior of breast support garment (100). In this view, sleep stay (104) is in a disengaged position. To engage sleep stay (104), a wearer can pull first edge (117) toward the center of front section (112), to enwrap the inner curve of their breast.

In some embodiments, the sleep stay is shaped like the letter "D," with a first edge that is straight (e.g., substantially straight) and a second edge that is arcuate (e.g., curved so that a portion of the second edge covers the skin of the breast and/or remains within the front section (e.g., a cup) of the garment when the sleep stay is engaged, see, e.g., FIG. 5). The two pointed ends where the edges meet may be elongated to facilitate attachment (e.g., sewing) to the garment (e.g., attachment to a strap and to the bottom edge of the inside of a cup). The ends of the sleep stay may be slightly pleated where the material is attached (e.g., sewn into place, e.g., tacked into place), and they may be attached (e.g., sewn into place, e.g., tacked into place) using micro-pleats (e.g., folds) to allow the sleep stay to "open-up" toward the center of the garment (e.g., toward the center of the chest of a wearer). The sleep stay may be attached to the garment such that the straight edge is configured to face the center of the garment (e.g., the center of the front section, e.g., the center of a wearer's chest) and the arcuate edge is configured to face the side of the garment (e.g., the side of a wearer's body). When the sleep stay is stretched to enwrap the inner curve of the breast of a wearer (e.g., engaged), such as when a wearer is reclining or lying on her side, the straight edge can fit around the inner curve of the breast and sit tightly against the chest and the arcuate edge can cover the skin of the breast. In some embodiments, the sleep stay is sized such that the curved edge remains within the front section of the garment (e.g., within a cup) and provides coverage for the nipple when the sleep stay is stretched to enwrap the inner curve of the breast. The length of the first edge (e.g., the straight edge) and the length of the second edge (e.g., the arcuate edge) may have a ratio of approximately 1:1.25 to 1:4 (e.g., 1:1.25, 1:1.5, 1:1.75, 1:2, 1:2.25, 1:2.5, 1:2.75, 1:3, 1:3.25, 1:3.5, 1:3.75, or 1:4, which may vary depending on breast and garment size. In some embodiments, the length of the first edge (e.g., the straight edge) and the length of the second edge (e.g., the arcuate edge) have a ratio of 1:2. In other embodiments, both the first and second edge of the sleep stay may be straight (e.g., substantially straight), which would still allow for breast tissue containment, breast separation, and/or horizontal and vertical support when pulled to enwrap the inner curve of the breast, but may reduce coverage of the skin of the breast and allow bare skin to show between the sleep stay and the front section (e.g., the cup) of the garment when the sleep stay is engaged. In some embodiments, both the first edge and the second edge of the sleep stay are arcuate. In some embodiments, the sleep stay is a crescent shape.

In some embodiments, the sleep stay is attached to the garment at two positions (e.g., at a first end to a position of the garment that is configured to rest below the breast of a wearer, and at a second end to a position of the garment that is configured to rest above the breast of a wearer). In embodiments in which the sleep stay is attached to the garment at two positions, the sleep stay has two edges. In some embodiments, the sleep stay is attached to the garment at only the first and second end, which leaves both edges of the sleep stay unattached to the garment and allows both edges of the sleep stay to move when the sleep stay is shifted between a disengaged and an engaged position (e.g., when the sleep stay is moved from a disengaged position to a position in which it enwraps the inner curve of the breast of a wearer). In other embodiments, the sleep stay is attached to the garment at more than two positions (e.g., 3, 4, 5, or more positions), which creates additional edges between the points of attachment. At least one edge of the sleep stay remains unattached to the garment so that it can be stretched to enwrap the inner curve of the breast of a wearer, and the remaining edges may be attached (e.g., sewn into the garment) or unattached.

In some embodiments, the sleep stay is sewn into the garment and is not removable. In other embodiments, the sleep stay can be fully detached from the garment (e.g., to allow for easy breast access, such as for breast feeding, or to allow for removal when the sleep stay is not needed to provide support, stability, or separation of the breasts, such as during daytime wear when the wearer is sitting upright). In embodiments in which the sleep stay is detachable, it can be attached to the garment using a fastener (e.g., a button, snap, hook, or hook and loop fastener (e.g., VELCRO®)). The sleep stay may be fully detachable from the garment (e.g., none of the ends of the sleep stay are sewn into the garment, e.g., the sleep stay is only attached to the garment using a fastener, e.g., a button, snap, hook, or hook and loop fastener (e.g., VELCRO®)), or the sleep stay may be may be detachable at one end (e.g., a top or upper end of the sleep stay) and sewn in at another end (e.g., a bottom or lower end of the sleep stay).

Bras Containing a Sleep Stay

Figure 6:
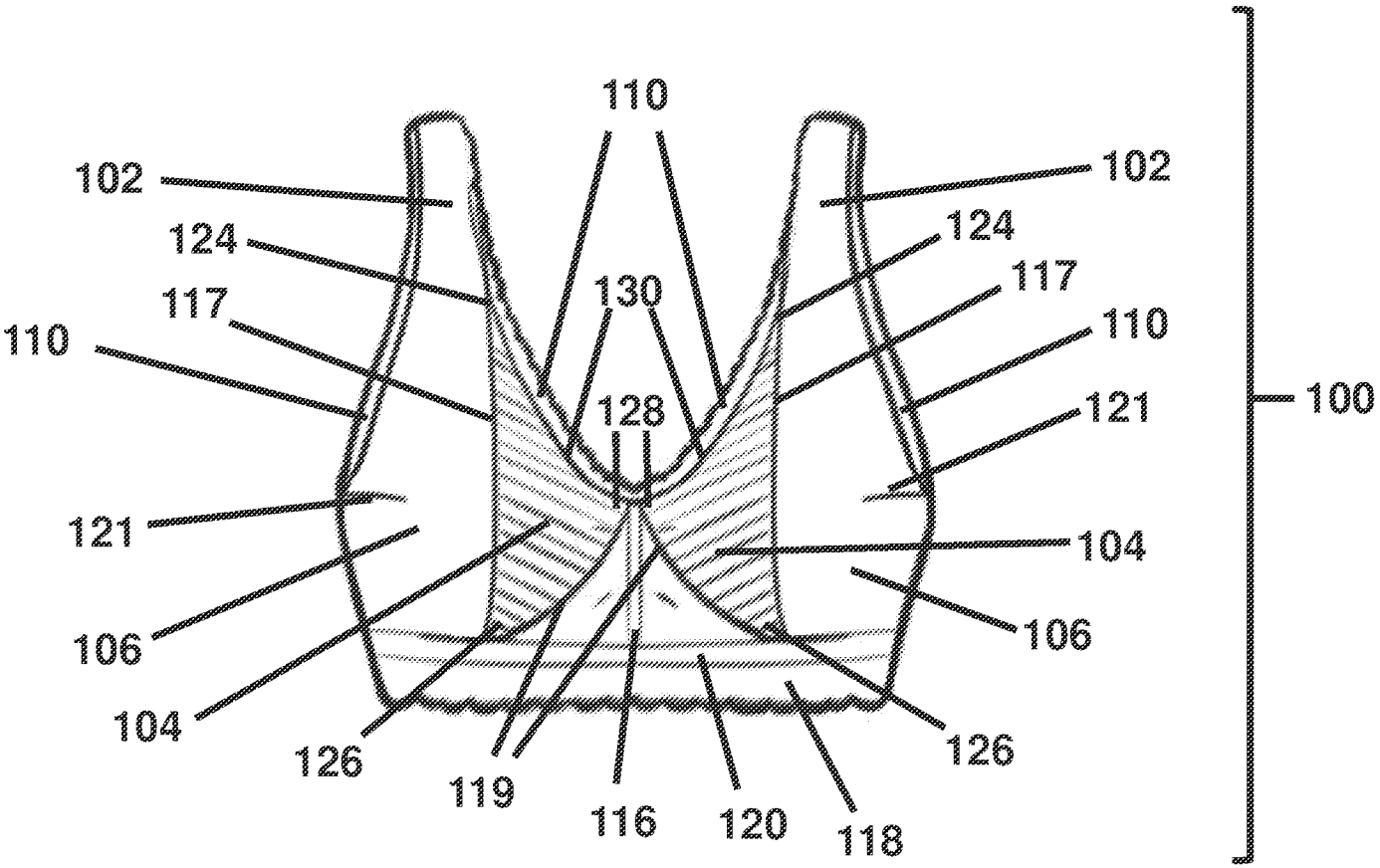
FIG. 6 is an interior view of breast support garment (100) when it is turned inside out, and includes strap (102), inner cup (106), sleep stay (104), elastic (110) lining the edges of inner cup (106), internal elastic (116), front band (118), and elastic band (120).
Figure 7B:
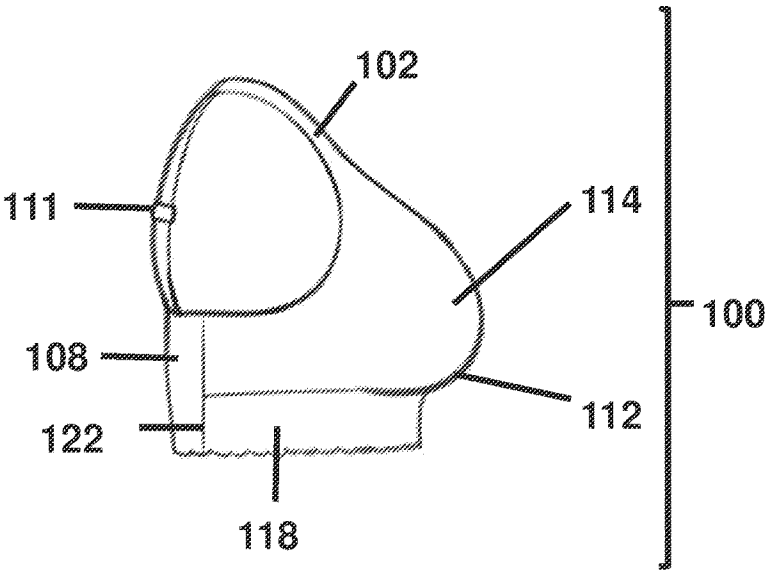
FIG. 7B is a right side view of breast support garment (100), which includes front section (112) containing outer cup (114) and front band (118), back section (108), strap (102), and side seam (122). Strap (102) may include adjuster (111) that allows the length of strap (102) to be modified. Front section (112) containing outer cup (114) and front band (118) may be made of the same material or of a different material than back section (108). Front section (112) and back section (108) may both be made of lace (e.g., stretch lace). Side seam (122) may be sewn using flat-lock stitching for additional comfort. Sleep stay (104) is in a disengaged position and is, therefore, not visible because it is contained within (e.g., hidden behind) the interior of front section (112).
Figure 7A:
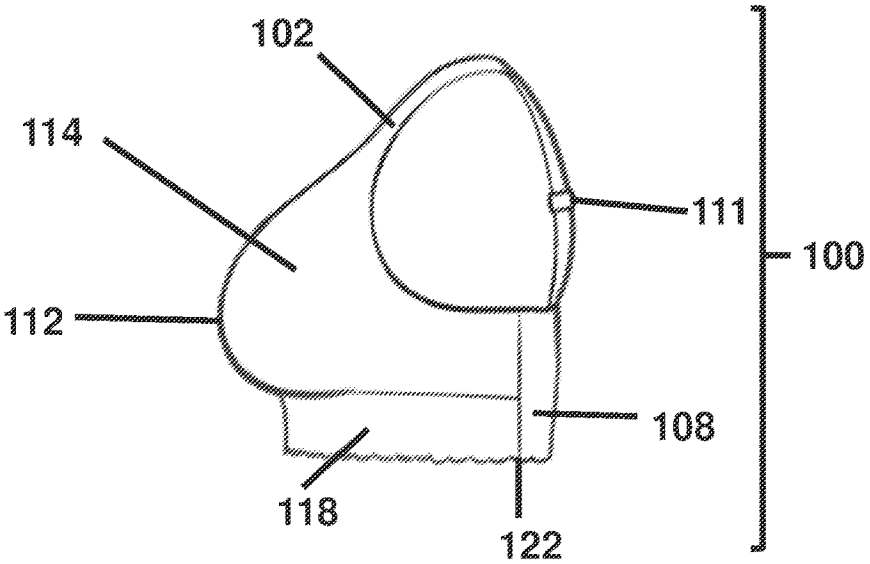
FIG. 7A is a left side view of breast support garment (100), which includes front section (112) containing outer cup (114) and front band (118), back section (108), strap (102), and side seam (122). Strap (102) may include adjuster (111) that allows the length of strap (102) to be modified. Front section (112) containing outer cup (114) and front band (118) may be made of the same material or of a different material than back section (108). Front section (112) and back section (108) may both be made of lace (e.g., stretch lace). Side seam (122) may be sewn using flat-lock stitching for additional comfort. Sleep stay (104) is in a disengaged position and is, therefore, not visible because it is contained within (e.g., hidden behind) the interior of front section (112).
Figure 8:
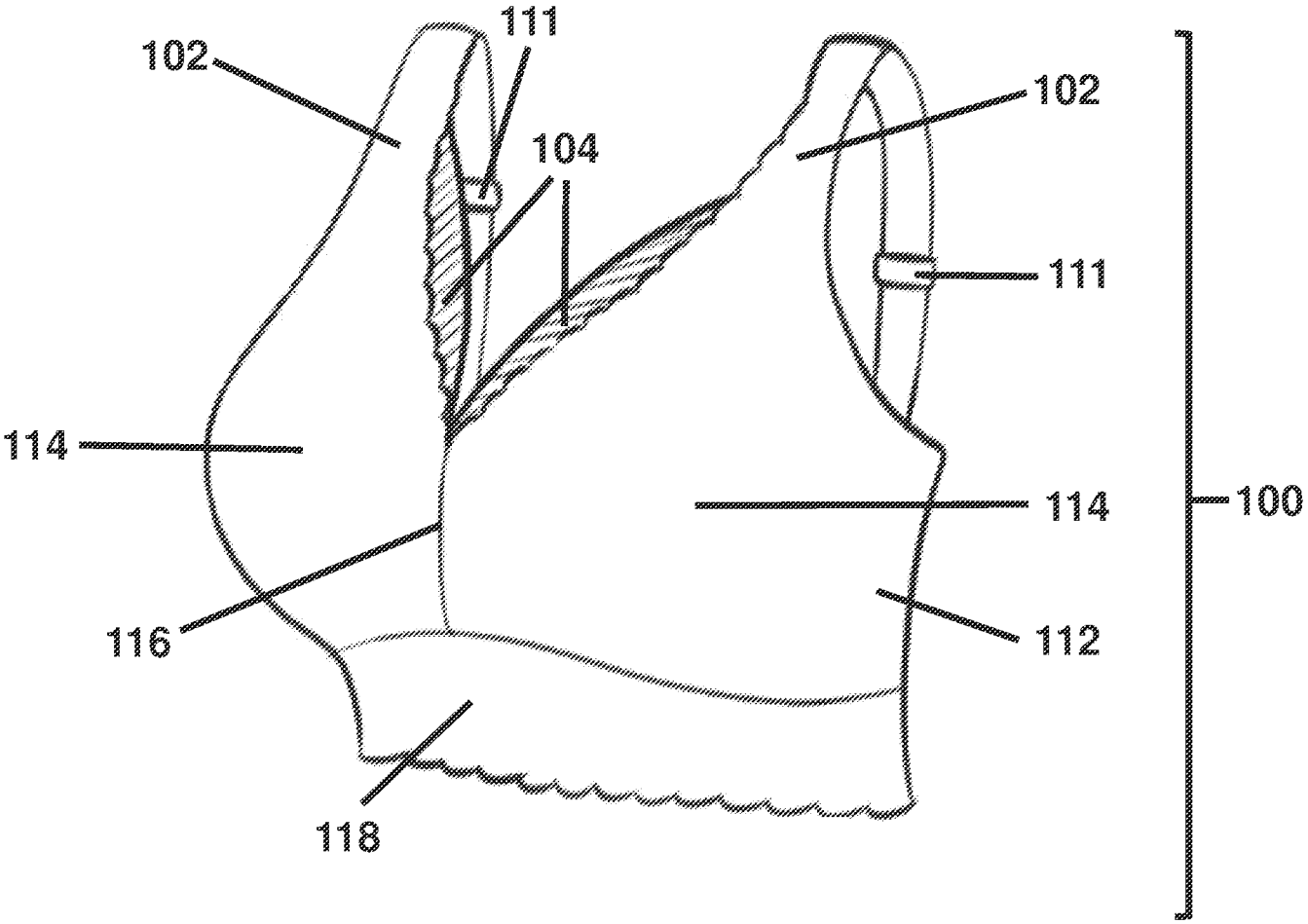
FIG. 8 is a front perspective view of breast support garment (100) in which sleep stay (104) is engaged, including strap (102), sleep stay (104), and front section (112) containing outer cup (114) and front band (118). Internal elastic (116) can be positioned below the outermost layer of fabric of front section (112) and between outer cups (114) to improve the fit and/or positioning of breast support garment (100) and may not be visible from the exterior of breast support garment (100). Sleep stay (104) may be visible when engaged (e.g., stretched to enwrap the inner curve of the breast). In the engaged position, a portion of sleep stay (104) may be visible from the exterior of breast support garment (100), and the remainder of sleep stay (104) may be contained within (e.g., hidden behind) front section (112). Sleep stay (104) may be made of a fabric that is the same type (e.g., material), color, and/or pattern as the fabric of front section (112), or of a fabric that is a different type (e.g., material), color, and/or pattern than the fabric of front section (112). The width of front band (118) can vary with the width of the back section of breast support garment (100). As the width of front band (118) increases, it may give breast support garment (100) a longline shape and reduce the movement of breast support garment (100) on the torso of the wearer. Front section (112), including outer cup (114) and front band (118) may be made with an outermost layer of lace (e.g., stretch lace). Strap (102) may include adjuster (111) that allows the length of strap (102) to be modified.
Figure 9B:
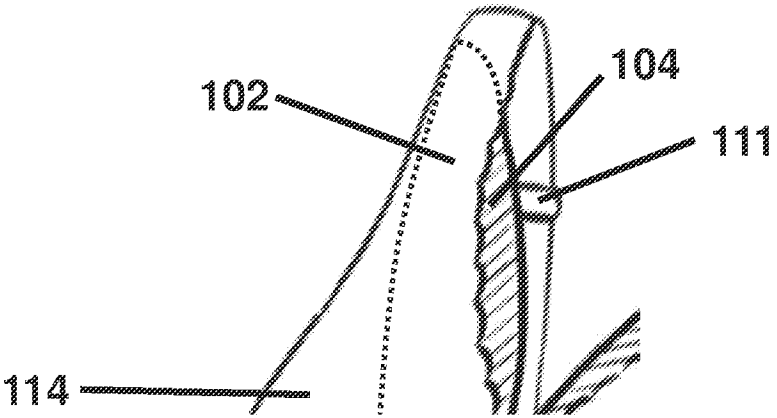
FIGS. 9A-9B are enlarged front perspective views of the portion of breast support garment (100) that includes sleep stay (104) and strap (102) that demonstrate two different alternatives for the attachment of sleep stay (104) to strap (102).
Figure 9A:
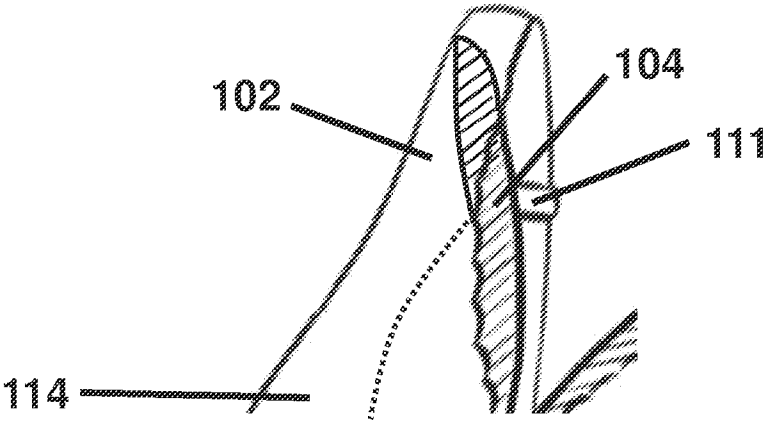
Figure 10B:
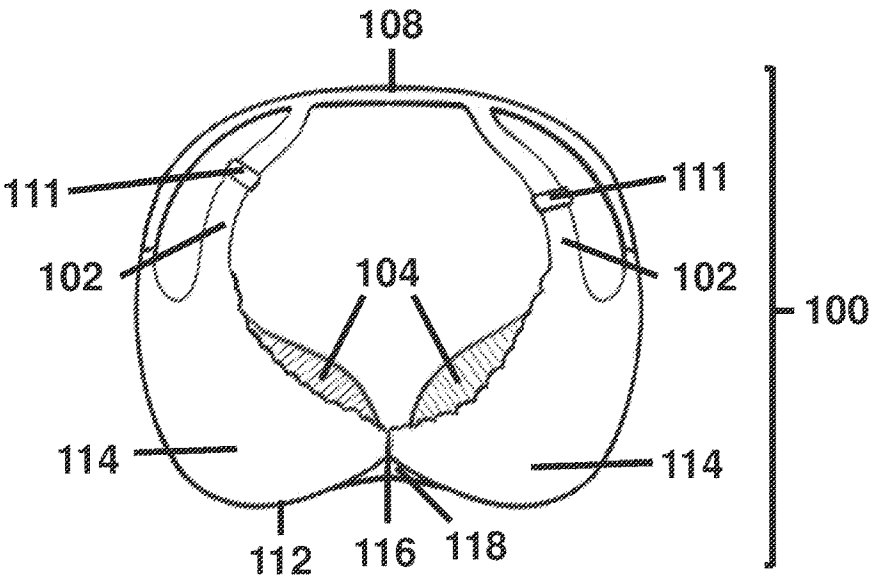
FIGS. 10A-10B are top views of breast support garment (100).
Figure 10A:
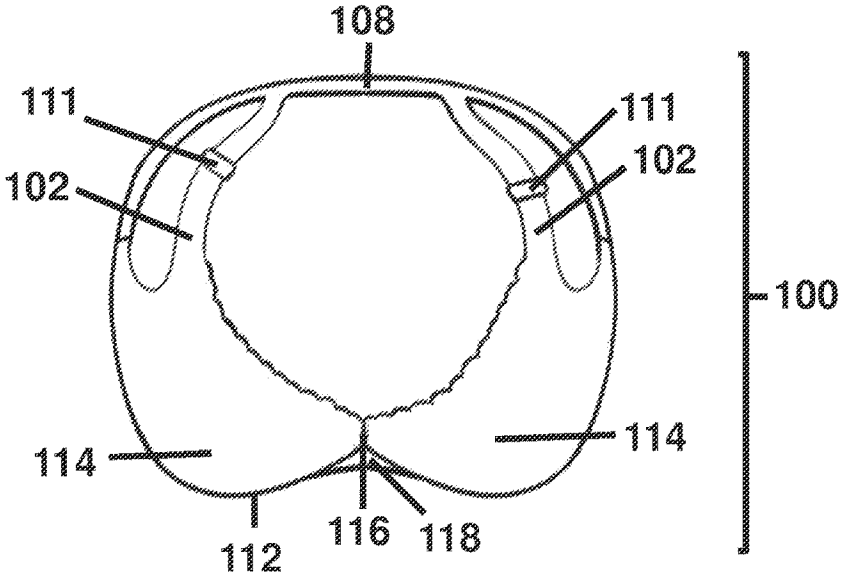

In embodiments in which the garment is a bra, the garment contains a front section including cup for each breast (e.g., a left cup and a right cup), and a strap connected to each cup (e.g., two straps, each connected to a cup, or a single strap, which is connected to both cups (e.g., one end of the strap is connected to the left cup and the other end of the strap is connected to the right cup)). Each cup of the garment contains a sleep stay, which may be attached to (e.g., sewn into) the bottom edge of the inside of the cup (e.g., anywhere along the bottom edge of the interior of the cup, such as at or near a midpoint) and to the strap (see, e.g., FIGS. 1, 2, 5, and 6). The sleep stay can lay inside each cup when not being used to provide stability, containment of breast tissue, separation of the breasts, or both vertical and horizontal support. The top end (e.g., upper end) of the sleep stay may be attached to the outside or the underside of the strap at any point along the strap that is configured to rest on the front of the body of a wearer (e.g., from the position of the strap that is configured to rest on the shoulder of a wearer to the position of the strap that connects to the top of the cup) or to the top of the cup (e.g., to the top of the interior of the cup). The top end (e.g., upper end) of the sleep stay may be attached (e.g., sewn into place, e.g., tacked into place) to the strap (e.g., to the underside of the strap) at a position that is about 0.5 inches to about 4.0 inches from the portion of the strap that is configured to rest on the wearer's collarbone (e.g., 0.5, 1.0, 1.5, 2.0, 2.5, 3.0, 3.5, or 4.0 inches above or below the portion of the strap that is configured to rest on the collarbone of a wearer, see, e.g., FIG. 5). In some embodiments, the top end of the sleep stay attaches to the strap (e.g., to the underside of the strap) at a position that is about 1 inch to about 2 inches from the portion of the strap that is configured to rest near or on the wearer's collarbone (e.g., about 1 inch to about 2 inches below the portion of the strap that is configured to rest on the wearer's collarbone). The bottom end (e.g., the lower end) of the sleep stay may be attached at the center of the bottom edge of the interior of the cup or up to 2 inches to either side of the center of the bottom edge of the interior of the cup (e.g., at the center of the bottom edge of the interior of the cup or 0.25, 0.5, 0.75, 1.0, 1.25, 1.5, 1.75, or 2.0 inches to the left or the right of the center of the bottom edge of the interior of the cup). The bottom end (e.g., lower end) of the sleep stay may be attached (e.g., sewn into place, e.g., tacked into place) at a single point at the bottom edge of the inside of the cup. In some embodiments, the bottom end (e.g., lower end) of the sleep stay is attached (e.g., sewn into place, e.g., tacked into place) at a single point in the center of the bottom edge of the inside of the cup (see, e.g., FIGS. 5 and 6).

In some embodiments, the sleep stay is attached to the garment at three positions: the bottom end (e.g., lower end) is attached to the bottom edge of the interior of the cup (e.g., at or near the center of the bottom edge of the interior of the cup), the top end (e.g., upper end) is attached to the strap (e.g., to the underside of the strap) or to the top of the cup (e.g., to the top of the interior of the cup), and a third end is attached to the edge of the cup that forms one side of the "V" at the center of a wearer's chest (e.g., to the interior edge of the cup that forms one side of the "V" at the center of a wearer's chest). For example, a portion of the edge of the sleep stay that is opposite the straight edge (e.g., a portion of the arcuate edge) can be attached to (e.g., sewn into) the interior edge of the cup that faces the center of the garment (e.g., the center of the front section, e.g., the edge of the cup that is configured to be positioned on or near the center of the wearer's chest, e.g., the edge of each cup that forms one side of the "V" at the center of the wearer's chest, see, e.g., FIG. 6), creating a third end and second and third edges. The top end (e.g., the upper end) of the sleep stay may be attached (e.g., sewn into place, e.g., tacked into place) to the strap (e.g., to the underside of the strap) and positioned such that the second edge (e.g., the arcuate edge), defined by a line between the bottom end (e.g., the lower end) and the third end (e.g., the new end created by attaching the sleep stay to the interior edge of the cup), is configured to face the center of the garment (e.g., the center of the front section, e.g., the center of a wearer's chest). The third edge, defined by a line between the top end (e.g., the upper end) of the sleep stay and the third end, may face the edge of the cup that forms one side of the "V" at the center of the garment (e.g., the center of the front section, e.g., at the center of a wearer's chest). The third edge may be attached to (e.g., sewn into) the interior edge of the cup that faces the center of the garment (e.g., the center of the front section, e.g., the edge of the cup that is configured to be positioned on or near the center of the wearer's chest) at one or more points (e.g., one, two, three, or more points). In some embodiments, one quarter of the length of the third edge, one third of the length of the third edge, one half of the length of the third edge, two thirds of the length of the third edge, three fourths of the length of the third edge, or more is attached to (e.g., sewn into) the interior edge of the cup that faces the center of the garment (e.g., the center of the front section, e.g., the edge of the cup that is configured to be positioned on or near the center of the wearer's chest). In some embodiments, the third edge is attached to (e.g., sewn into) the interior edge of the cup along the entire length of the interior edge of the cup (e.g., from the top of the cup to the midpoint of the front section of the garment). In some embodiments, the third edge is sewn into the interior edge of the cup that faces the center of the garment (e.g., the center of the front section, e.g., the edge of the cup that is configured to be positioned on or near the center of the wearer's chest) starting from the point of attachment of the top end of the sleep stay to the garment and continuing to the center of the front section of the garment where the two cups meet (e.g., the entire length of the third edge is sewn into the garment). In embodiments in which the third edge of the sleep stay is attached to the interior edge of the cup that faces the center of the garment (e.g., the center of the front section, e.g., the edge of the cup that is configured to be positioned at or near the center of the wearer's chest), the first edge of the sleep stay (e.g., the straight edge), defined by a line between the top end (e.g., the upper end) and the bottom end (e.g., the lower end) of the sleep stay may be configured to face the side of the garment (e.g., the side of the wearer's body). The bottom end (e.g., the lower end) of the sleep stay may be attached (e.g., sewn into place, e.g., tacked into place) at a single point along the bottom edge of the inside of the cup (e.g., at or near the center of the bottom edge of the inside of the cup). When the sleep stay is engaged (e.g., when the first edge of the sleep stay is stretched to enwrap the inner curve of the breast of a wearer), the sleep stay may form a pocket-like structure that can hold the breast.

Figure 1B:
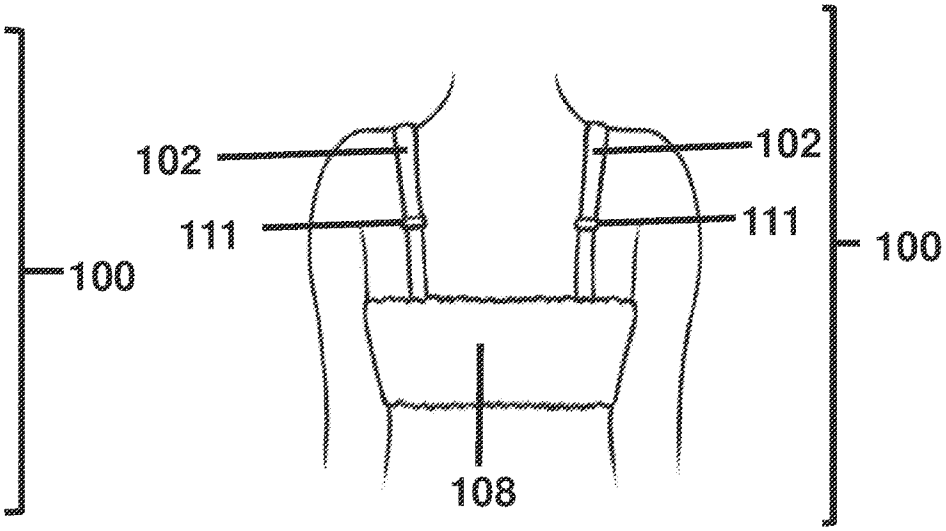
FIGS. 1A-1B are back views of breast support garment (100).
Figure 1A:
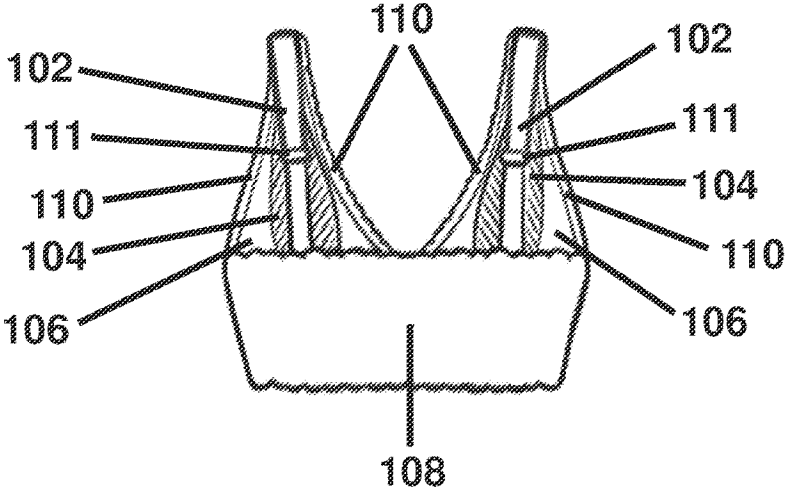
Figure 2B:
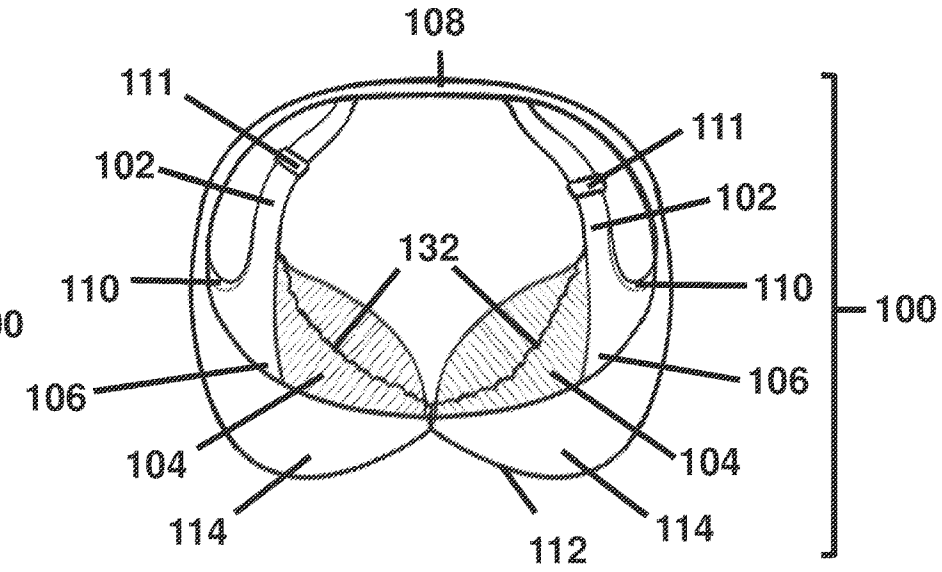
FIG. 2A-2B are a bottom views of breast support garment (100).
Figure 2A:
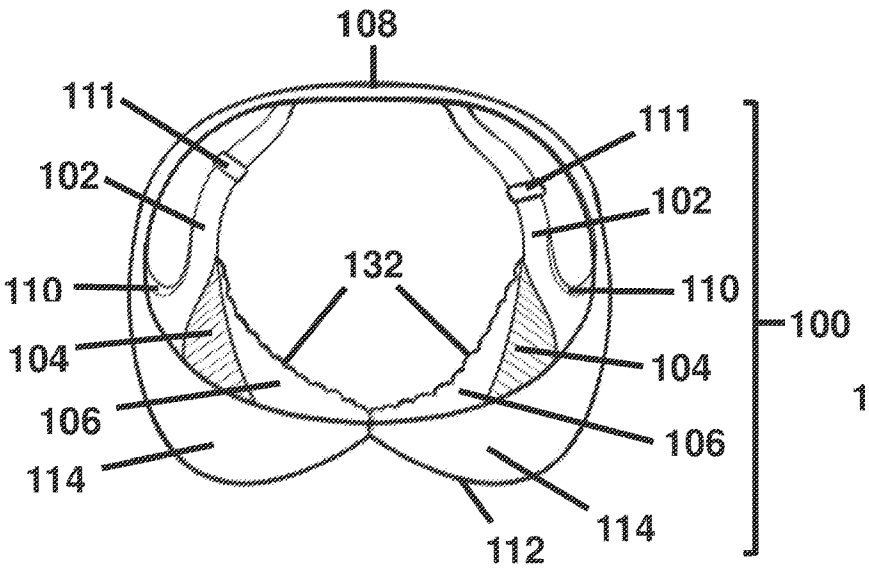
Figure 3B:
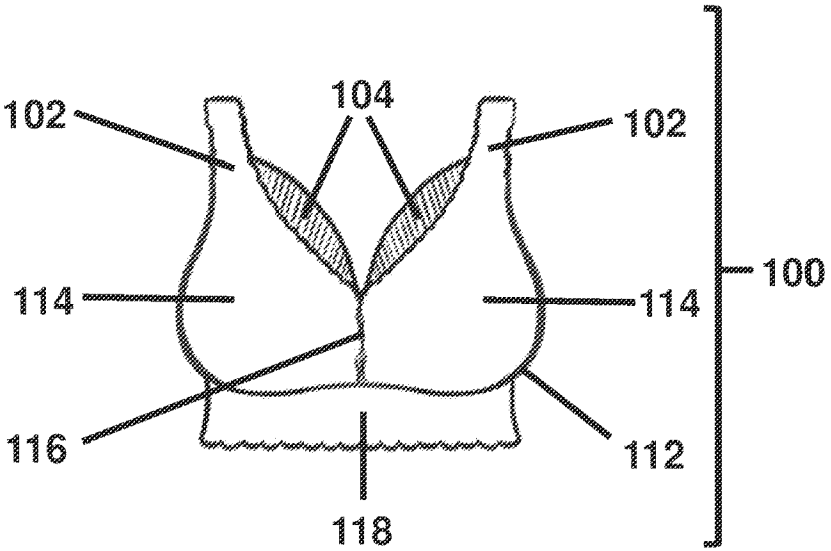
FIGS. 3A-3B are front views of breast support garment (100), which can be, or can be incorporated into, a bra, a swimsuit (e.g., a one-piece or two-piece swimsuit), a tank top, shapewear, sleepwear (e.g., a nightie, a nightgown, or a pajama top (e.g., a pajama tank top)), activewear, or a shirt (e.g., a T-shirt).
Figure 3A:
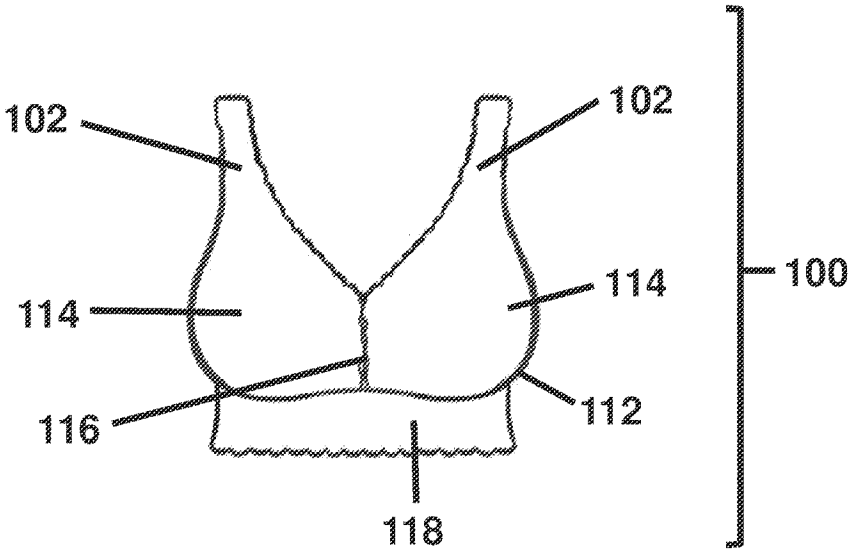
Figure 4B:
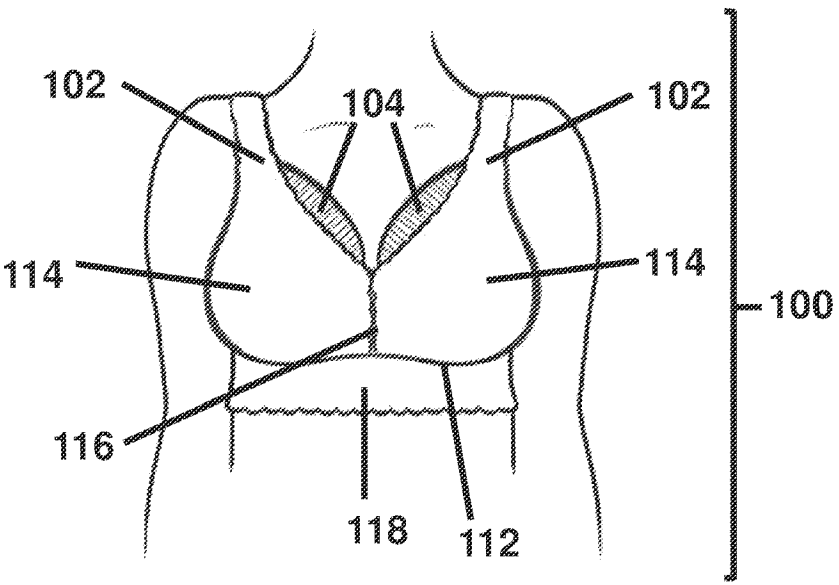
FIGS. 4A-4B are front views of breast support garment (100) on a wearer.
Figure 4A:
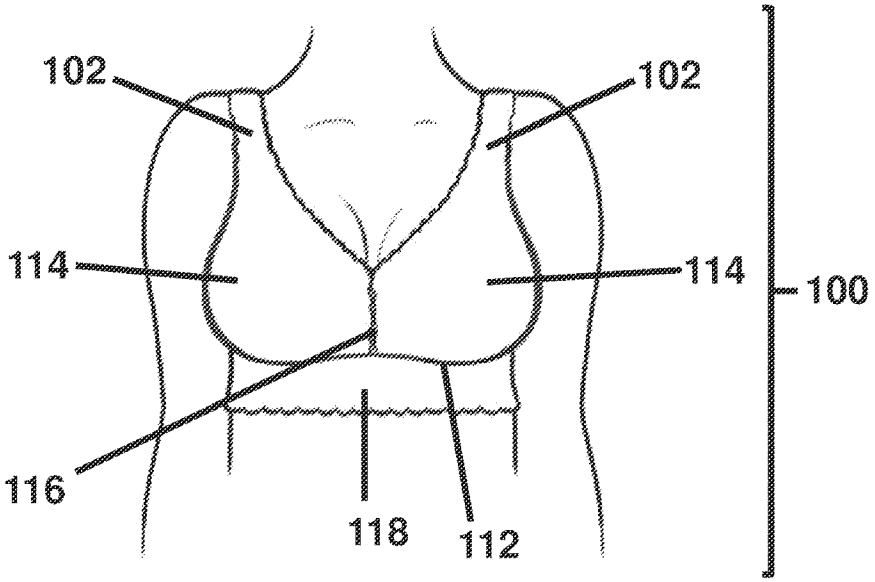

The garment may further include a back section (see, e.g., FIG. 1). The back section of the garment may be made of one or more layers of fabric (e.g., one, two, three, or more layers of fabric) that is configured to run horizontally from the left side to the right side of the wearer's back. The length of the back section of the garment may vary depending on the size of the garment (e.g., depending on the band size of the garment). The width of the back section of the garment may be about 2 inches to about 8 inches (e.g., 2.0, 2.5, 3.0, 3.5, 4.0, 4.5, 5.0, 5.5, 6.0, 6.5, 7.0, 7.5, or 8.0 inches wide, e.g., measuring from the top of the back section to the bottom of the back section). In some embodiments, the width of the back section of the garment is about 5.5 inches wide. In some embodiments, the back section is wider than the back section of a traditional bra. The back section of the garment may be made of any type of fabric (e.g., cotton, nylon, polyester, spandex (elastane), lace, silk, stretch silk charmeuse, rayon, tricot, raschel, mesh, power mesh, jersey, or a blend, such as a nylon/spandex blend). In some embodiments, the back section of the garment is made of the same fabric as the front section of the garment. In some embodiments, the back section of the garment is made of a different fabric than the front section of the garment. In some embodiments, the back section of the garment is made of a single layer of lace (e.g., stretch lace). For example, the single layer or the outermost layer of the back section of the garment may be made of lace (e.g., stretch lace) when the single layer or the outermost layer of the front section of the garment is made of lace (e.g., stretch lace).

Other Garments Containing a Sleep Stay

The sleep stay may also be incorporated into other types of garments, such as a swimsuit (e.g., a one-piece or two-piece swimsuit), a tank top, shapewear, sleepwear (e.g., a nightie, a nightgown, or a pajama top (e.g., a pajama tank top)), activewear (e.g., a crop top, a leotard, a short sleeve shirt, or a long sleeve shirt), or a shirt (e.g., a T-shirt). In some embodiments, the garment includes a strap (e.g., two straps or a single strap that wraps around the neck), a sleep stay, and a front section that may include one or more of a front band that is configured to rest against the torso under the breasts, elastic lining the inside of the front band, and a cup for each breast (e.g., in embodiments in which the garment is a swimsuit (e.g., a one-piece or two-piece swimsuit), a tank top, shapewear, sleepwear (e.g., a nightie, a nightgown, or a pajama tank top), or activewear (e.g., a crop top or a leotard)). The top end (e.g., upper end) of the sleep stay may be attached to the outside or the underside of the strap at any point along the strap that is configured to rest on the front of the body of a wearer (e.g., from the position of the strap that is configured to rest on the shoulder of a wearer to the position of the strap that connects to the top of the front section or cup) or to the top of the cup (e.g., to the top of the interior of the cup) if the garment includes a cup. The top end of the sleep stay may be attached (e.g., sewn into place, e.g., tacked into place) to the strap (e.g., to the underside of the strap) at a position that is about 0.5 inches to about 4 inches from the portion of the strap that is configured to rest near or on the wearer's collarbone (e.g., 0.5, 1.0, 1.5, 2.0, 2.5, 3.0, 3.5, or 4.0 inches above or below the portion of the strap that is configured to rest on the collarbone of a wearer). In some embodiments, the top end of the sleep stay attaches to the strap (e.g., to the underside of the strap) at a position that is about 1 inch to about 2 inches from the portion of the strap that is configured to rest near or on the wearer's collarbone (e.g., about 1 inch to about 2 inches below the portion of the strap that is configured to rest on the wearer's collarbone).

In embodiments in which the garment includes a front band and does not include cups, the bottom end (e.g., lower end) of the sleep stay can be attached to (e.g., sewn into) the interior of the front band (e.g., at any point along the front band that is configured to rest below the breast of a wearer, such as from a position along the inside surface of the front band that is configured to rest below the outer curve of the breast of a wearer to a position along the inside surface of the front band that is configured to rest below the inner curve of the breast of a wearer). In some embodiments, the bottom end of the sleep stay attaches at a position on the inside surface of the front band that is configured to rest at or near the center point below the breast of a wearer. The sleep stay may attach to the inside surface of the front band at a single point that is configured to rest below the breast of a wearer or at multiple points that are configured to rest below the breast of a wearer (e.g., 2, 3, 4, 5 or more points).

In embodiments in which the garment includes cups (e.g., includes cups with or without a front band), the bottom end (e.g., lower end) of the sleep stay can be attached to (e.g., sewn into, e.g., tacked into place at) the bottom edge of the interior of the cup (e.g., at any point along the bottom edge of the interior of the cup, such as at the center of the bottom edge of the interior of the cup or up to 2 inches to either side of the center of the bottom edge of the interior of the cup (e.g., at the center of the bottom edge interior of the cup or 0.25, 0.5, 0.75, 1.0, 1.25, 1.5, 1.75, or 2.0 inches to the left or the right of the center of the bottom edge of the interior of the cup)). In embodiments in which the garment includes at least a strap (e.g., two straps or a single strap that wraps around the neck), a sleep stay, and a front section containing a cup for each breast, the sleep stay may attach to the garment in the same way it attaches to a bra.

In embodiments in which the garment does not include a strap, such as in a shirt (e.g., a T-shirt), a pajama top that is not a tank top, or a long sleeve or short sleeve activewear shirt, the garment includes a sleep stay, and a front section that may include one or more of a front band that is configured to rest under the breasts, elastic lining the inside of the front band, and a cup for each breast. The bottom end of the sleep stay can attach to the front band or cup as described above, and the top end of the sleep stay can attach to the inside surface of the front of the garment at any point that is configured to rest on the front of the body of a wearer above the breast (e.g., from the position of the garment that is configured to rest on the shoulder of a wearer to the position of the garment that is configured to rest about 4 inches below the collarbone of a wearer). The top end of the sleep stay may be attached (e.g., sewn into place, e.g., tacked into place) to the garment at a position that is about 0.5 inches to about 4 inches from the portion of the garment that is configured to rest on the wearer's collarbone (e.g., 0.5, 1.0, 1.5, 2.0, 2.5, 3.0., 3.5, or 4.0 inches above or below the portion of the garment that is configured to rest on the collarbone of a wearer). In some embodiments, the top end of the sleep stay attaches to the garment at a position that is about 1 inch to about 2 inches from the portion of the garment that is configured to rest near or on the wearer's collarbone (e.g., about 1 inch to about 2 inches below the portion of the garment that is configured to rest on the wearer's collarbone). The top end of the sleep stay may be sewn into the inside surface of the front of the garment or may be attached to the garment using a fastener (e.g., a button, snap, hook, or hook and loop fastener (e.g., VELCRO®)).

In embodiments in which the garment is tight-fitting on the upper body (e.g., is designed to rest directly on the chest and/or torso of a wearer and exhibit minimal movement (e.g., is designed to show the contours of the body), e.g., is made of spandex (elastane), a nylon/spandex blend, or an elastomeric fabric) the sleep stay may be attached directly to the garment without need of a band, cup, or strap. The tight-fitting garment may be a swimsuit (e.g., a one-piece or two-piece swimsuit), a tank top, shapewear, sleepwear (e.g., a nightie, a nightgown, or a pajama top (e.g., a pajama tank top)), activewear (e.g., a crop top, a leotard, a short sleeve shirt, or a long sleeve shirt), or a shirt (e.g., a T-shirt). In embodiments in which the garment is tight-fitting on the upper body, the garment includes a sleep stay and a front section (e.g., a front section configured to fit tightly against the chest and/or torso of a wearer). The garment can optionally include one or more of a strap, a front band, and a cup for each breast. The bottom end of the sleep stay can attach to the inside surface of the front section of the garment at a position of the garment that is configured to rest below the breast of a wearer (e.g., at any position along the inside surface of the garment that is configured to rest below the breast of a wearer, such as from a position of the garment that is configured to rest below the outer curve of the breast of a wearer to a position of the garment that is configured to rest below the inner curve of the breast of a wearer). In some embodiments, the bottom end of the sleep stay attaches to the inside surface of the garment at a position that is configured to rest at or near the center point below the breast of a wearer. The sleep stay may attach to the inside surface of the garment at a single point that is configured to rest below the breast of a wearer or at multiple points that are configured to rest below the breast of a wearer (e.g., 2, 3, 4, 5 or more points). If the garment includes a front band and/or a cup, the bottom end of the sleep stay can be attached to the front band or cup as described above. The top end of the sleep stay can attach to the inside surface of the front section of the garment at any point that is configured to rest on the front of the body of a wearer above the breast (e.g., from the position of the garment that is configured to rest on the shoulder of a wearer to the position of the garment that is configured to rest about 4 inches below the collarbone of a wearer). The top end of the sleep stay may be attached to the garment at a position that is about 0.5 inches to about 4 inches from the portion of the garment that is configured to rest on the wearer's collarbone (e.g., 0.5, 1.0, 1.5, 2.0, 2.5, 3.0., 3.5, or 4.0 inches above or below the portion of the garment that is configured to rest on the collarbone of a wearer). In some embodiments, the top end of the sleep stay attaches to the garment at a position that is about 1 inch to about 2 inches from the portion of the garment that is configured to rest near or on the wearer's collarbone (e.g., about 1 inch to about 2 inches above or below the portion of the garment that is configured to rest on the wearer's collarbone, e.g., about 1 inch to about 2 inches below the portion of the garment that is configured to rest on the wearer's collarbone). If the garment includes a strap, the top end of the sleep stay can be attached to the strap as described above. For example, if the tight-fitting garment includes a sleep stay, a tight-fitting front section, and a strap, but does not include a band or a cup (e.g., in embodiments in which the garment is a swimsuit, shapewear, a tank top, a crop top, or a leotard), the top end of the sleep stay may attach to the strap as described above and the bottom end of the sleep stay may attach to the inside surface of the front section of the garment. The top end and/or the bottom end of the sleep stay may be sewn into the garment or may be attached to the garment using a fastener (e.g., a button, snap, hook, or hook and loop fastener (e.g., VELCRO®)).

In any of the above embodiments, the sleep stay may be made of the same fabric, have the same orientation, have the same shape, and/or have the same dimensions as the sleep stay for use in a bra or related garment. A third end of the sleep stay may also be attached to the garment at a position that is configured to rest on or near the center of the chest of a wearer (e.g., to a position along the inside surface of the front band that is configured to rest on or near the center of the chest of a wearer, to the inside surface of the cup along the edge of the cup that faces the center of the garment (e.g., along the edge of the cup that forms one side of the "V" at the center of the garment and is configured to rest on or near the center of a wearer's chest), or to a position on the inside surface of the front section of the garment that is configured to rest near the center of the chest of a wearer). In embodiments in which the garment includes a cup, a third end of the sleep stay may be attached to the garment in the same way that the third end of the sleep stay is attached to a bra, as described above.

Other Properties of a Garment Containing a Sleep Stay

The garment includes a front section that may contain a cup for each breast (see, e.g., FIGS. 2, 3, 4, 8, and 10). The cup can include fabric formed to fit the breast of a wearer, and may be seamed or seamless to provide shape and support. The front section may be made of one or more layers of fabric (e.g., one, two, three, or more layers of fabric). Any type of fabric may be used (e.g., cotton, nylon, polyester, spandex (elastane), lace, silk, stretch silk charmeuse, rayon, tricot, raschel, mesh, power mesh, jersey, or a blend, such as a nylon/spandex blend) to produce the front section of the garment. In some embodiments (e.g., in embodiments in which the garment is a bra), the front section is made of an outer layer of lace (e.g., stretch lace) with a layer of mesh (e.g., micromesh) underneath. The outermost layer (e.g., the lace layer) may be strategically seamed across the bust in such a way as to provide additional volume size for each breast (e.g., for each cup), and the inner layer(s) (e.g., the mesh layer) may be attached to the outermost layer (e.g., the lace layer) at seams on each side of the garment, the top of the front section (e.g., the top of the cup), and the bottom of the front section (e.g., the bottom of the cup) for stability. The front section (e.g., the innermost layer of the front section) may also be darted for shaping. The front section may contain the cups and/or a front band that is configured to rest on the torso below the breasts of a wearer (e.g., below the cups). The front band may be 0.25 to 5 inches wide (e.g., 0.25, 0.5, 1.0, 1.5, 2.0, 2.5, 3.0, 3.5, 4.0, 4.5, or 5.0 inches wide, e.g., measuring from the top of the front band to the bottom of the front band) and may be made of one or more layers of fabric (e.g., one, two, three, or more layers of fabric). The front band may be made of the same fabric as the outermost layer of the garment (e.g., cotton, nylon, polyester, spandex (elastane), lace, silk, stretch silk charmeuse, rayon, tricot, raschel, mesh, power mesh, jersey, or a blend, such as a nylon/spandex blend) or of a different fabric. For example, in embodiments in which the front section contains an outer layer of lace (e.g., stretch lace) and in inner layer of mesh (e.g., mesh) (e.g., in embodiments in which the garment is a bra), the front band may also be made of an outer layer of lace (e.g., stretch lace) and an inner layer of mesh. In embodiments in which the garment does not include cups (e.g., in embodiments in which the garment is a tank top or a swimsuit that does not include cups), the front band may be made of an elastic or a material that includes elastic. A wider front band can be used to give the garment a longline shape and may help keep the garment in place on the torso of a wearer. The front band may be shortened to make the garment more comfortable for women during pregnancy. The width of the front band may be related to the width of the back section. For example, the width of the front band may increase as the width of the back section increases. Similarly, the width of the front band may decrease as the width of the back section narrows. In some embodiments, the front section does not include a front band. In some embodiments, the front section does not include cups. An elastic band may be positioned along the center seam (e.g., a seam of the garment that is configured to be positioned between the breasts, such as a seam between the two cups) in the front section of the garment (e.g., between the outermost layer and innermost layer of fabric). The elastic band may not be visible from the exterior and/or the interior of the garment and may improve the fit and/or positioning of the front section of the garment. The interior (e.g., the inside surface, e.g., the side that is configured to touch the skin of the wearer) of the front section may also include elastic that runs along the edges of the front section (e.g., along the top edge and/or the along the edges that are configured to rest near the underarm of a wearer, e.g., along the edges of the cups). Soft touch plush elastic (e.g., lingerie elastic) can be used for additional comfort. In some embodiments, different types of elastic are used to line different edges on the interior of the garment (e.g., on the interior of the cup). For example, soft touch plush elastic may be used on the inside of the edges of the garment that are configured to run under the arm (e.g., inside of the edge of each cup that is configured to run under the arm), and stretch elastic may be used on the inside of the top edge of the front section (e.g., on the inside of the edge of each cup that is configured to sit on or near the center of the wearer's chest (e.g., the edge of each cup that forms one side of the "V" at the center of the garment)). In some embodiments, soft touch plush elastic may be used to line the top and underarm edges of the garment (e.g., both edges on the inside of the cup).

The garment may further include a back section (see, e.g., FIG. 1). The back section of the garment may be made of one or more layers of fabric (e.g., one, two, three, or more layers of fabric) that is configured to run horizontally from the left side to the right side of the wearer's back. The length of the back section of the garment may vary depending on the size of the garment (e.g., depending on the band size of the garment). The width of the back section of the garment may be about 2 inches to about 8 inches (e.g., 2.0, 2.5, 3.0, 3.5, 4.0, 4.5, 5.0, 5.5, 6.0, 6.5, 7.0, 7.5, or 8.0 inches wide, e.g., measuring from the top of the back section to the bottom of the back section). In some embodiments, the width of the back section of the garment is about 5.5 inches wide. In some embodiments, the back section is wider than the back section of a traditional garment (e.g., wider than the back section of a traditional bra). The back section of the garment may be made of any type of fabric (e.g., cotton, nylon, polyester, spandex (elastane), lace, silk, stretch silk charmeuse, rayon, tricot, raschel, mesh, power mesh, jersey, or a blend, such as a nylon/spandex blend). In some embodiments, the back section of the garment is made of the same fabric as the front section of the garment. In some embodiments, the back section of the garment is made of a different fabric than the front section of the garment. In some embodiments, the back section of the garment is made of a single layer of lace (e.g., stretch lace). For example, the single layer or the outermost layer of the back section of the garment may be made of lace (e.g., stretch lace) when the single layer or the outermost layer of the front section of the garment is made of lace (e.g., stretch lace). In embodiments in which the garment includes a front section that is tight-fitting, the back section may also be tight-fitting (e.g., fit tightly against the back of a wearer).

The garment may be configured with two straps, each strap being connected to the top of a respective cup on the front section of the garment. Each strap may be configured to run over the shoulder of a wearer and connect to the back section of the garment (e.g., the top of the back section of the garment). Alternatively, the straps may be configured to tie at the back of the neck. The strap may be adjustable (e.g., may contain an adjuster that allows the length of the strap to be modified by a wearer, if needed) and/or padded (e.g., padded throughout the length of the strap, or padded in the portion of the strap that is configured to rest on the shoulder of a wearer). In some embodiments, the two straps do not cross (e.g., each strap runs from the top of the front section (e.g., the top of the cup) on one side of the garment (e.g., the right or left) to the same side (e.g., the right or left) of the back section of the garment). In some embodiments, the straps are configured to cross over the back of a wearer (e.g., each strap runs from the top of the front section (e.g., the top of the cup) on one side of the garment (e.g., the right or left) to the opposite side (e.g., the left or right) of the back section of the garment). In some embodiments, the garment is configured as a racerback garment (e.g., a racerback bra, tank top, crop top, or swimsuit), in which the straps connect the front section of the garment (e.g., the cups) to an x-shaped piece of fabric at the back of the garment, which is also connected to the back section of the garment. In some embodiments, the x-shaped piece of fabric is made out of lace.

In other embodiments, the garment contains a single strap that is configured to wrap around the back of the neck (e.g., a single strap is attached at one end to the right side (e.g., the right cup) of the front section and at the other end to the left side (e.g., the left cup) of the front section, e.g., a single strap connects one cup to the other cup by wrapping around the back of the neck) and does not connect to the back section (e.g., the garment is a configured as a halter garment (e.g., a halter bra, swimsuit, or tank top)).

In some embodiments, the straps can be detached from the front section of the garment (e.g., detached from the front section and/or detached from the top of the sleep stay) to allow for easy breast access (e.g., for breast feeding). In embodiments in which the strap is detachable, it can be attached to the front section of the bra (e.g., to a cup) and/or to the sleep stay using a fastener (e.g., a button, snap, hook, or hook and loop fastener (e.g., VELCRO®)). The width of the strap may be wider than that of a traditional garment (e.g., wider than that of a traditional bra). In some embodiments, the strap is 0.25 to 2.5 inches wide (e.g., 0.25, 0.5, 0.75, 1.0, 1.25, 1.5, 1.75, 2.0, 2.25, or 2.5 inches wide). In some embodiments, the width of the strap is constant throughout the length of the strap. In some embodiments, the strap is widest at the point of connection to the front of the garment (e.g., to the point of connection to the cup) and/or in the portion of the strap that is configured to rest on the shoulder of a wearer, and the width of the strap is reduced in the portion of the strap that is configured to rest on the back of a wearer and/or that connects to the back section of the garment.

The garment may also include under-arm side panels. The side panels provide additional support to the outer side of each breast and can be double-reinforced. When worn during sleep, the under-arm side panels can help to reduce shifting of the garment on the torso of a wearer and/or movement of the breasts during sleep (e.g., back-sleeping). The side of the garment (e.g., where the front section and back section meet) may be wider than the side of a traditional garment (e.g., wider than that of a traditional bra), which may allow the side of the garment (e.g., the bra) to reach a position on the body that is higher than that reached by a traditional garment (e.g., a traditional bra).

The seams of the garment can be made using flat-lock stitching to ensure that a flat seam is produced without additional material or thread overhang. This can make the garment more comfortable, as the reduction in excess fabric and other materials can make for a smoother surface (e.g., a smoother surface on which to sleep). The seams can also be covered with a slim piece of fabric or plush elastic (e.g., lingerie elastic) to provide additional comfort. The garment may also be made without the use of any hard metals or plastics, which can also make the garment more comfortable than traditional garments (e.g., more comfortable than traditional bras). In some embodiments, the only metal or plastic included in the garment is the adjuster used to modify the length of the strap (e.g., a plastic or metal adjuster) or the fastener used to make the strap and/or the sleep stay detachable (e.g., a plastic or metal hook, button, or snap). In some embodiments, the garment does not have a closure (e.g., a front or back set of interlocking hook-and-eye closures), and a wearer can put on the garment by stepping into it or pulling it on over the head. In some embodiments, the garment has a front closure system including hook-and-eye closures positioned over a padded strip of fabric that attaches to the front section of the garment, which allows the garment to be completely opened from the front. In this embodiment, a wearer can put on the garment by putting each arm through an armhole and closing the garment in front rather than stepping into or pulling on the garment. In some embodiments, the garment has a back closure system including hook-and-eye closures positioned over a padded strip of fabric that attaches to the back section of the garment, which allows the garment to be completely opened from the back. In this embodiment, a wearer can put on the garment by putting each arm through an armhole and closing the garment in back rather than stepping into or pulling on the garment. The garment may contain an elastic band positioned along the length of the interior of the front section and the back section (e.g., a continuous elastic band configured to encircle the torso of a wearer). The elastic band may be positioned on the interior of the front section such that it rests under the breasts (e.g., positioned at the base of the cups, e.g., where the cups and front band meet or along the front band) and may be positioned on the interior of the back section such that the position of the elastic band is level throughout the garment. The elastic band may be soft touch plush elastic (e.g., lingerie elastic).

The garment may further include a sling. The sling may be attached at a bottom end to a portion of the garment that is configured to rest below the breast (e.g., the bottom edge of the interior of a cup, the inside surface of a front band, or the inside surface of a tight-fitting front section at a position that is configured to rest below the breast of a wearer), and at a top end to a portion of the garment that is configured to rest near the underarm (e.g., the edge of the cup that is configured to rest near the underarm of a wearer, or a portion (e.g., an edge) of the front section that is configured to rest near the underarm of a wearer). In embodiments in which the garment includes a cup for each breast (e.g., in embodiments in which the garment is a bra), the sling may be attached at one end to the bottom edge of the interior of each cup (e.g., anywhere along the bottom edge of the interior of the cup, e.g., at or near the center of the bottom edge of the interior of the cup or 0.25, 0.5, 0.75, 1.0, 1.25, 1.5, 1.75, or 2.0 inches to the left or the right of the center of the bottom edge of the interior of the cup) and at the other end to the under-arm portion of the interior of the cup (e.g., to the top of the under-arm portion of the interior of the cup). The sling may be attached (e.g., sewn into place, e.g., tacked into place) at a single point at the bottom edge of the inside of the cup, such as at a single point in the center of the bottom edge of the inside of the cup. The sling may provide additional vertical support and/or help to position the breast toward the center of the chest (e.g., re-position breasts that naturally point toward the side of the body)

The garment (e.g., a bra or other garment as described herein) can be produced in a variety of sizes. Sizes include: extra small 1 (e.g., a band (e.g., the fabric that encircles the torso below the breast, e.g., the combined length of the front and back sections) that fits women with a 28-30 band size and cups that fit women with DD-F cup size); extra small 2 (e.g., a band that fits women with a 28-30 band size and cups that fit women with a G-I cup size); small 1 (e.g., a band that fits women with a 30-32 band size and cups that fit women with a DD-F cup size); small 2 (e.g., a band that fits women with a 30-32 band size and cups that fit women with a G-I cup size); medium 1 (e.g., a band that fits women with a 32-34 band size and cups that fit women with a DD-F cup size); medium 2 (e.g., a band that fits women with a 32-34 band size and cups that fit women with a G-I cup size); large 1 (e.g., a band that fits women with a 34-36 band size and cups that fit women with a DD-F cup size); large 2 (e.g., a band that fits women with a 34-36 band size and cups that fit women with a G-I cup size); extra-large 1 (e.g., a band that fits women with a 36-38 band size and cups that fit women with a DD-F cup size); and extra-large 2 (e.g., a band that fits women with a 36-38 band size and cups that fit women with a G-I cup size).

The garment may be worn during low-impact activity, such as during leisure (e.g., standing, walking, sitting, reclining, or laying down) or sleep, and/or may be worn at any time of day. The garment may be used to provide both vertical and horizontal support during sleep (e.g., the sleep stay may be stretched to enwrap the inner curve of the breast to reduce gravity-induced sideways motion of the breast for a woman with a large, full bust during sleep, e.g., side-sleeping), and/or the garment may be worn during the day like a traditional leisure garment (e.g., like a traditional leisure bra). Accordingly, the garment may be used to contain and/or stabilize breast tissue to reduce or prevent breast movement when a wearer is likely to move between different positions (e.g., the sleep stay may be stretched to enwrap the inner curve of the breast while a wearer is sleeping, reclining, or leaning over) and/or move during the course of daily activities (e.g., e.g., the sleep stay may be stretched to enwrap the inner curve of the breast while a wearer is walking). The garment may also be used to physically separate the breasts (e.g., by enwrapping the sleep stays around the inner curve of the breasts to separate them, e.g., during side-sleeping when the breasts are typically pressed together by the effects of gravity). When vertical and horizontal support is not needed, such as when a wearer is sitting in an upright position, the sleep stays can be positioned inside the front section (e.g., inside the cups) of the garment (e.g., not enwrapping the breasts, e.g., in a disengaged position). Alternatively, a wearer can engage the sleep stay (e.g., enwrap the inner curve of the breast) when vertical and horizontal support is not needed (e.g., for the purpose of fashion due to the unique positioning of the sleep stay on the chest when engaged). For example, a wearer can engage the sleep stays to enwrap the breasts while wearing clothing with a low cut neckline so that the sleep stays are visible.

The garment described herein is suitable for a wearer with a full bust and a small band size who may have limited options when shopping for traditional garments (e.g., traditional bras). The garment may also be worn by a wearer who is uncomfortable without support for the breasts during sleep, or a wearer who is concerned about chest wrinkles that may result from side-sleeping. The garment is also suitable for a wearer who is looking to reduce the probability of developing sagging breasts. As the garment does not contain underwire or hard metals or plastics, the garment is suitable for a wearer looking for a wire-free garment (e.g., a wire-free bra) or a wearer looking for a comfortable, supportive garment in which to sleep or recline (e.g., recline or lay down on a couch). The garment may also be worn by a wearer looking for a single garment that provides both vertical and horizontal support (e.g., a garment that can be worn during the day and night without needing to change). Due to the stretch of the fabric used to make the garment and the lack of wires, the garment can be worn by pregnant women in need of a garment (e.g., a bra) that can stretch to accommodate their growing band size, or by women who are experiencing growing or shrinking cup size (e.g., due to pregnancy or weight gain or loss). The garment is suitable for post-surgical wear (e.g., after breast augmentation, breast reduction, breast reconstruction, or other breast surgery) as it can be worn continuously (e.g., during sleep and during the day) and provides support without wires. If the garment is produced with detachable straps and/or sleep stays, the garment may be used by women who are nursing. The garment is also suitable for a wearer with sensitive skin looking for a bra or garment with flat-lock seams that may be more comfortable against the skin than the standard seaming found in other bras or garments. The stretch fabric and adjustable straps make the garment suitable for a variety of different body shapes and wearers with torsos of different lengths.

Uses

Breast support garment (100) is suitable for a wearer with a full bust and a small band size, a wearer who would like a garment (e.g., a bra) that can be worn during the day and while sleeping (e.g., a garment, such as a bra, that provides vertical and horizontal support), and a wearer who would like a garment (e.g., a bra) that can accommodate changing cup and/or band sizes (e.g., a wearer who is pregnant, a wearer who is gaining or losing weight, or a wearer undergoing breast reduction, breast reconstruction, breast augmentation, or other surgery that may change the size of the breasts). With reference to FIGS. 1-12, when sleep stay (104) is engaged (e.g., stretched to enwrap the inner curve of the breast of a wearer), it can provide vertical and horizontal support to counteract the effect of gravity (e.g., horizontal support to reduce sideways motion of the breasts during sleep, e.g., during side-sleeping), which may reduce chest wrinkles and slow or prevent the development of sagging breasts. When sleep stay (104) is stretched to enwrap the inner curve of the breast of a wearer, breast support garment (100) may also serve to stabilize and/or contain breast tissue as the wearer moves between different positions and/or moves (e.g., walks) during the course of daily activities (e.g., to reduce up-and-down and/or side-to-side motion of the breasts induced by movement). Sleep stay (104) can also be engaged (e.g., stretched to enwrap the inner curve of the breast of a wearer) to physically separate the breasts (e.g., to reduce or prevent the breasts from pressing together during side sleeping). Breast support garment (100) may be made of a stretch fabric and strap (102) may be adjustable (e.g., may include adjuster (111)) so that the garment can be worn by women with a variety of different body shapes and torso lengths. The lack of underwire and hard metals or plastics in breast support garment (100) and the use of flat-lock seams can render the garment more comfortable than traditional garments (e.g., bras) and suitable for post-surgical and post-partum wear and for use by a wearer with sensitive skin. Strap (102) can be made to be detachable to facilitate nursing. Breast support garment (100) may be worn for sleep and/or leisure activities (e.g., it may serve as a sleep bra and/or a leisure bra).

Breast support garment (100) contains front section (112) that may be made of one or more layers of fabric (e.g., one, two, three, or more layers of fabric). The one or more layers of fabric may be made of any fabric (e.g., a soft, stretch fabric, e.g., cotton, nylon, polyester, spandex (elastane), lace, silk, stretch silk charmeuse, rayon, tricot, raschel, mesh, power mesh, jersey, or a blend, such as a nylon/spandex blend). In some embodiments, the one or more layers of front section (112) are made of the same fabric. In some embodiments, the one or more layers of front section (112) are made of different fabric. For example, the outer layer, including outer cup (114) and front band (118) may be made of a lace fabric (e.g., a stretch lace), and the inner layer, including inner cup (106) and the side of front band (118) that is configured to contact the skin of wearer, may be made of mesh (e.g., a micromesh or power mesh). Inner cup (106) may also include dart (121) to improve fit. Front band (118) may be 0.25 to 4 inches wide (e.g., 0.25, 0.5, 0.75, 1.0, 1.5, 2.0, 2.5, 3.0, 3.5, or 4.0 inches wide, e.g., measuring from the top to the bottom of the band) and may be made of one or more layers of fabric (e.g., cotton, nylon, polyester, spandex (elastane), lace, silk, stretch silk charmeuse, rayon, tricot, raschel, mesh, power mesh, jersey, or a blend, such as a nylon/spandex blend). Front band (118) may be of the same fabric as the remainder of front section (112) or of a different fabric.

Front section (112) is connected at the sides of breast support garment (100) to back section (108), which may be made of one or more layers of fabric (e.g., one, two, three, or more layers of fabric). The one or more layers of fabric may be any fabric (e.g., a soft, stretch fabric, e.g., cotton, nylon, polyester, spandex (elastane), lace, silk, stretch silk charmeuse, rayon, tricot, raschel, mesh, power mesh, jersey, or a blend, such as a nylon/spandex blend). In some embodiments, the outermost layer of fabric of back section (108) is the same as the outermost layer of fabric of front section (112) (e.g., the outermost layer of both portions may be lace (e.g., stretch lace)). In some embodiments, the outermost layer of fabric of back section (108) is different from the outermost layer of fabric of front section (112). In some embodiments, back section (108) is made of a single layer of lace (e.g., stretch lace). In some embodiments, back section (108) also contains an inner layer of mesh (e.g., micromesh or power mesh). Back section (108) may be about 2 inches to about 8 inches wide (e.g., 2.0, 2.5, 3.0, 3.5, 4.0, 4.5, 5.0, 5.5, 6.0, 6.5, 7.0, 7.5, or 8.0 inches wide, e.g., measuring from the top of back section (108) toward the bottom of back section (108)), such as 5.5 inches wide. Front section (112) and back section (108) can be connected by side seam (122), which may be sewn using flat-lock stitching to make breast support garment (100) more comfortable (e.g., more comfortable for use during sleep than a traditional garment (e.g., bra)).

Front band (118) may help to reduce shifting of breast support garment (100) on the torso of a wearer, as might elastic (110) lining the edges of inner cup (106), internal elastic (116) positioned between the outermost and innermost layers of fabric of front section (112) and between the cups, and elastic band (120) that runs the length of front section (112) and back section (108) to encircle the torso of a wearer. Strap (102) may be adjustable (e.g., may include adjuster (111)) and/or padded for improved comfort and fit. The width of strap (102) may be wider than that of a traditional garment (e.g., bra). In some embodiments, strap (102) is 0.25 to 2.5 inches wide (e.g., 0.25, 0.5, 0.75, 1.0, 1.25, 1.5, 1.75, 2.0, 2.25, or 2.5 inches wide).

Vertical and horizontal support can be provided by sleep stay (104), which may reside within front section (112) (e.g., within inner cup (106)) when not engaged (e.g., when disengaged). Sleep stay (104) may be made of a knit and/or elastomeric fabric (e.g., cotton, nylon, polyester, spandex (elastane), lace, silk, stretch silk charmeuse, rayon, tricot, raschel, mesh, power mesh, jersey, rubber fabric, lastol, neoprene, or a blend, such as a nylon/spandex blend). In some embodiments, sleep stay (104) is made of mesh, power mesh, or jersey fabric. Top end (124) (e.g., the upper end) of sleep stay (104) may be attached (e.g., sewn) to strap (102) (e.g., to the outside or underside of strap (102)) at any point along strap (102) that is configured to rest on the front of the body of a wearer (e.g., from the position of strap (102) that is configured to rest on the shoulder of a wearer to the position of strap (102) that connects to the top of interior cup (106)). The top end (124) of sleep stay (104) may be attached (e.g., sewn into place, e.g., tacked into place) to strap (102) (e.g., to the underside of strap (102)) at a position that is about 0.5 inches to about 4 inches from the portion of strap (102) that is configured to rest on the collarbone of a wearer (e.g., 0.5, 1.0, 1.5, 2.0, 2.5, 3.0, 3.5, or 4.0 inches from the portion of strap (102) that is configured to rest on the collarbone of a wearer). In some embodiments, top end (124) of sleep stay (104) attaches to strap (102) (e.g., to the underside of strap (102)) at a position that is about 1 inch to about 2 inches from the portion of strap (102) that is configured to rest near or on the wearer's collarbone (e.g., about 1 inch to about 2 inches below the portion of strap (102) that is configured to rest on the wearer's collarbone). Bottom end (126) (e.g., the lower end) of sleep stay (104) may be attached (e.g., sewn) to the bottom edge of interior cup (106) (e.g., at the center of the bottom edge of interior cup (106) or up to 2 inches to either side of the center of the bottom edge of interior cup (106), e.g., at the center of the bottom edge of interior cup (106) or 0.25, 0.5, 0.75, 1.0, 1.25, 1.5, 1.75, or 2.0 inches to the left or the right of the center of the bottom edge of interior cup (106)). In some embodiments, bottom end (126) of sleep stay (104) is attached (e.g., sewn into place, e.g., tacked into place) at a single point in the bottom center of interior cup (106). Sleep stay (104) may be about 0.5 inches to about 4.0 inches wide (e.g., 0.5, 0.75, 1.0, 1.25, 1.5, 1.75, 2.0, 2.25, 2.5, 2.75, 3.0, 3.25, 3.5, 3.75, or 4.0 inches wide). Sleep stay (104) may have first edge (117) that is straight (e.g., substantially straight) or arcuate and second edge (119) that is straight (e.g., substantially straight) or arcuate. In some embodiments, first edge (117) is straight (e.g., substantially straight) and second edge (119) is arcuate (e.g., curved to cover the skin of the breast and/or remain partially contained within the cup when the sleep stay is stretched to enwrap the breast of a wearer).

To provide both vertical and horizontal support (e.g., to reduce horizontal (e.g., side-to-side) and/or vertical (e.g., up-and-down) movement of the breasts when a wearer is not sitting in an upright position, such as when a wearer is reclining or sleeping, e.g., side-sleeping, or when a wearer is moving, e.g., walking or changing positions), to physically separate the breasts, and/or to stabilize the breasts, first edge (117) (e.g., the straight edge) of sleep stay (104) can be stretched to enwrap the inner curve of the breast. Second edge (119) (e.g., the arcuate edge) of sleep stay (104) can provide coverage for the breast of a wearer so that the skin of the breast is not visible between the first edge of sleep stay (104) and the edge of outer cup (114). In some embodiments, sleep stay (104) is attached such that first edge (117) (e.g., the straight edge) of sleep stay (104) is configured to face the center of front section (112) (e.g., the center of the chest of a wearer) and second edge (119) (e.g., the arcuate edge) of sleep stay (104) is configured to face the side of front section (112) (e.g., the side of the body of a wearer). In other embodiments, a portion of the edge of sleep stay (104) that is opposite first edge (117) (e.g., a portion of the arcuate edge of sleep stay (104)) may be attached to (e.g., sewn into) the edge of inner cup (106) that faces the center of front section (112) (e.g., the edge of inner cup (106) that is configured to rest on or near the center of the chest of a wearer, forming one side of the "V" at the center of the chest), creating third end (128), second edge (119), and third edge (130). In this configuration, sleep stay (104) creates a pocket-like structure to hold the breast when first edge (117) (e.g., the straight edge) is stretched to enwrap the inner curve of the breast. In this embodiment, sleep stay (104) is attached such that first edge (117) (e.g., the straight edge) of sleep stay (104) is configured to face the side of front section (112) (e.g., the side of the body of a wearer), second edge (119) (e.g., the arcuate edge) of sleep stay (104) is configured to face the center of front section (112) (e.g., the center of the chest of a wearer), and third edge (130) of sleep stay (104) is configured to face the edge of inner cup (106) that faces the center of front section (112) (e.g., the edge of inner cup (106) that is configured to rest on or near the center of the chest of a wearer).

When sleep stay (104) is engaged, it may extend beyond the edge of outer cup (114) and be visible from the front of breast support garment (100). Due to this visibility, sleep stay (104) can also be stretched to enwrap the inner curve of the breast when it is not needed for support, separation, or stabilization (e.g., when a wearer is sitting upright) if a wearer decides that they would like sleep stay (104) to be visible (e.g., when wearing an article of clothing with a V-neck or low cut neckline (e.g., for additional coverage of the breast or to enhance the look of the article of clothing)). Sleep stay (104) may be of the same color, pattern, and/or fabric as the outermost layer of front section (112), or sleep stay (104) may be of a different color, pattern, and/or fabric than the outermost layer of front section (112).

To reduce discomfort, breast support garment (100) may be made without any clasps (e.g., without a front closure or back closure), and a wearer can put on breast support garment (100) by pulling it on over the head or stepping into it. In embodiments in which breast support garment (100) is made with a front or back closure system, a wearer can put on breast support garment (100) by putting each arm through an armhole and securing the closure in the front or back.

The following examples are intended to illustrate, rather than limit, the invention.

EXAMPLES

Example 1

Use of the Breast Support Garment to Provide Lateral Support for Breasts During Sleep A woman with a full bust (e.g., a woman with a full bust and small band size) can wear breast support garment (100) during sleep. In the absence of breast support garment (100), the woman's breasts would be pressed together and pulled toward the bed by gravity during sleep (e.g., while side-sleeping). To promote physical separation and reduce motion of her breasts during sleep, the woman can wear breast support garment (100) and can engage sleep stays (104) (e.g., stretch sleep stays (104) to enwrap the inner curve of her breasts). Sleep stays (104) reduce side-to-side movement of the woman's breasts (e.g., movement of the breasts toward the bed during side-sleeping) and physically separate her breasts. Breast support garment (100) is made with flat-lock seams and lacks underwire and metals or plastics aside from the material of adjuster (111), if present, and is, therefore, comfortable and does not disrupt the woman's sleep. With continued wear, breast support garment (100) can help to reduce the formation of chest wrinkles and the sagging of the woman's breasts.

Example 2

Use of the Breast Support Garment by a Wearer Who is Pregnant

A pregnant woman (e.g., a pregnant woman with a full bust and small band size) can wear breast support garment (100) during and after pregnancy. Breast support garment (100) can be made of a knit and/or elastomeric fabric (e.g., lace, such as stretch lace), and can, therefore, be worn as the woman's band size and cup size increase during pregnancy. The woman can wear breast support garment (100) during the day due to the comfort provided by the stretch fabric, flat-lock seams, and lack of underwire, hard metals, or plastics in breast support garment (100) (with the exception of adjuster (111), which may be made of plastic if included in breast support garment (100)). The woman may choose not to engage sleep stays (104) (e.g., not stretch sleep stays (104) to enwrap the inner curve of her breasts) while she is at work during the day if she does not require vertical and/or horizontal support for and/or stabilization or containment of her breasts (e.g., if she sits or stands upright and does not need to reduce the movement of her breasts). When sleep stays (104) are disengaged, sleep stays (104) remain within interior cups (106) and would not be visible from the outside of the garment. When the woman returns home from work, she may wish to recline. She can engage sleep stays (104) (e.g., stretch sleep stays (104) to enwrap her breasts) for vertical and/or horizontal support (e.g., to reduce side-to-side and/or up-and-down motion of her breasts) and/or containment or stabilization of her breast tissue. She can also wear breast support garment (100) while sleeping and can stretch sleep stays (104) to enwrap her breasts to provide vertical and/or horizontal support (e.g., to reduce the gravity-induced sideways motion of her breasts during sleep) and to keep her breasts physically separated. The woman can continue to wear breast support garment (100) after giving birth, as breast support garment (100) can accommodate her changing band size and cup size. The woman may also experience postpartum breast pain and sensitivity, and the design of breast support garment (100) can provide more comfort than a standard bra.

Other Embodiments

While the invention has been described in connection with specific embodiments thereof, it will be understood that it is capable of further modifications and this application is intended to cover any variations, uses, or adaptations of the invention following, in general, the principles of the invention and including such departures from the invention that come within known or customary practice within the art to which the invention pertains and may be applied to the essential features hereinbefore set forth, and follows in the scope of the claims.

Other embodiments are within the claims.

The invention claimed is:

1. A breast support garment comprising:

a) a front section having inside and outside surfaces and top and bottom edges and comprising:
   i) left and right cups, each said cup having an area to receive a breast of a wearer, and/or
   ii) a front band configured to span a length of the front section and to rest against a wearer's torso below the wearer's breasts;

b) i) at least two straps, each of which is connected to a top of a respective cup on the front section of the garment or at the top edge of the front section of the garment; or
   ii) a single strap having first and second ends, each of which is connected to a top of a respective cup on the front section of the garment or to the top edge of the front section of the garment; and c) a moveable stay comprising a layer of fabric for each respective breast positioned inside the front section of the garment in a disengaged position, wherein each said stay comprises at least a first lower end attached along a bottom edge of an inside surface of the cup or along a portion of an inside surface of the front band that is configured to be positioned below a breast of a wearer and a second upper end attached near a top of an inside surface of the cup or along a portion of the respective strap, and wherein each said stay is configured to be pulled over and around the breast of the wearer from the disengaged position to an engaged position, thereby enwrapping the breast of the wearer with the stay to and including an inner curve of the breast.

2. The garment of claim 1, wherein the front band comprises elastic.

3. The garment of claim 1, wherein said garment further comprises a back section connected to the front section and comprising at least one layer of fabric that is configured to span a wearer's back.

4. The garment of claim 3, wherein each of said straps is connected at a first end to the top of a respective cup on the front section of the garment or to the top edge of the front section of the garment and at a second end along the back section.

5. The garment of claim 1, comprising:

a) a front section having inside and outside surfaces and top and bottom edges and comprising left and right cups, each said cup having an area to receive a breast of a wearer, and a back section connected to the front section and comprising at least one layer of fabric that is configured to span a wearer's back; and b) two straps, each of which is connected at a first end to a top of a respective cup on the front section of the garment and at a second end along the back section.

6. The garment of claim 1, wherein the fabric of the stay is a knit and/or elastomeric fabric;

a mesh, power mesh, or jersey fabric, or a compression fabric.

7. The garment of claim 6, wherein the stay comprises a stretch knit fabric.

8. The garment of claim 1, wherein each said stay is about 0.5 inches to about 4.0 inches wide.

9. The garment of claim 1, wherein the first lower end of each said stay is attached at or near a central point along the bottom edge of the inside surface of the cup.

10. The garment of claim 1, wherein each said stay comprises a first edge defined by a straight or arcuate line between the second upper end and the first lower end of the stay, wherein the first edge is configured to be oriented toward a center of the garment, and a second edge defined by a straight or arcuate line between the second upper end and the first lower end of the stay, wherein the second edge is configured to be oriented toward a side of the garment.

11. The garment of claim 10, wherein the first edge is configured to enwrap an inner curve of a breast of a wearer.

12. The garment of claim 10, wherein the first edge is straight and/or the second edge is arcuate.

13. The garment of claim 10, wherein a length of the first edge and a length of the second edge have a ratio of approximately 1:1.25 to 1:4.

14. The garment of claim 13, wherein the length of the first edge and the length of the second edge have a ratio of approximately 1:2.

15. The garment of claim 1, wherein each said stay further comprises a third end attached along an edge of the inside surface of the cup that is configured to rest on or near a center of a wearer's chest during wear or attached along a portion of the inside surface of the front band that is configured to be positioned below a breast of a wearer.

16. The garment of claim 15, wherein the third end is attached along an edge of the inside surface of the cup that is configured to rest on or near the center of a wearer's chest during wear, wherein each said stay comprises:

i) a first edge defined by a straight or arcuate line between the second upper end and the first lower end of the stay, wherein the first edge is configured to be oriented toward a side of the garment, ii) a second edge defined by a straight or arcuate line between the first lower end and the third end of the stay, wherein the second edge is configured to be oriented toward a center of the garment, and iii) a third edge defined by a straight or arcuate line between the second upper end and the third end of the stay, wherein the third edge is configured to be oriented toward the edge of the cup that is configured to rest on or near the center of a wearer's chest during wear.

17. The garment of claim 1, wherein the garment further comprises a sling that is configured to provide additional vertical support to a breast of a wearer.

18. The garment of claim 5, wherein the front section further comprises a front band.

19. The garment of claim 1, wherein the second upper end of each said stay is attached to the respective strap at any position along the strap between a point of attachment to the top of the cup or the top of the front section and a portion of the strap that is configured to rest on a shoulder of a wearer.

20. The garment of claim 1, wherein the second upper end of each said stay is attached to the respective strap at a position that is about 0.5 inches to about 4.0 inches from a point of said strap that is configured to rest on a collarbone of a wearer.

21. The garment of claim 20, wherein the second upper end of each said stay is attached to the respective strap at a position that is about 1 inch to about 2 inches from the point of said strap that is configured to rest on the collarbone of a wearer.

22. The garment of claim 1, wherein the second upper end of each said stay is attached along an underside of the respective strap.

23. The garment of claim 1, wherein each said stay is configured to provide vertical and horizontal support to the respective breast of the wearer.

24. The garment of claim 1, wherein each said stay further comprises a moveable seam for modification of the length and/or position of the stay in the garment.

25. The garment of claim 3, wherein each strap is connected at the second end to the at least one layer of fabric on the back section of the garment.

26. The garment of claim 1, wherein the garment does not comprise underwire.

27. The garment of claim 3, wherein the garment comprises an elastic band that spans the length of an inside surface of the front section of the garment and an inside surface of the back section of the garment and is configured to encircle a torso of the wearer.

28. The garment of claim 1, wherein each said stay is not visible from an exterior of the garment when the stay is in the disengaged position and is visible from the exterior of the garment when the stay is in the engaged position.

29. The garment of claim 1, wherein each said stay provides vertical and/or horizontal support for a breast of a wearer when the stay is in the engaged position.

30. The garment of claim 1, wherein the garment is a bra.

31. The garment of claim 1, wherein:

(a) the garment is a swimsuit;

(b) the garment is shapewear;

(c) the garment is sleepwear;

(d) the garment is a shirt; or (e) the garment is activewear.

32. A method of reducing or inhibiting movement of a breast of a subject, the method comprising clothing the subject in the breast support garment of claim 1 and moving each said stay of the breast support garment to the engaged position, thereby enwrapping an inner curve of each said breast.

33. A method of stabilizing a breast of a subject, the method comprising clothing the subject in the breast support garment of claim 1 and moving each said stay of the breast support garment to the engaged position, thereby enwrapping an inner curve of each said breast.

34. A method of physically separating a subject's breasts, the method comprising clothing the subject in the breast support garment of claim 1 and moving each said stay of the breast support garment to the engaged position, thereby enwrapping an inner curve of each said breast.

35. A method of reducing post-surgical breast pain or discomfort in a subject, the method comprising clothing the subject in the breast support garment of claim 1 and moving each said stay of the breast support garment to the engaged position, thereby enwrapping an inner curve of each said breast, wherein support of the breast by the stay reduces movement of the breast, thereby reducing the post-surgical breast pain or discomfort.

36. The method of claim 33, where the subject is a pregnant subject.

37. The method of claim 32, wherein the stay reduces or inhibits vertical and/or horizontal movement of the breast.

38. The method of claim 32, wherein the garment reduces one or more of the formation of chest wrinkles, breast sagging, and pain or discomfort associated with breast movement or breast size by supporting the breast and limiting movement thereof.

39. The method of claim 32, wherein the garment is sized for a subject with a band size of about 28 to about 38 and a cup size of DD or larger.

40. The garment of claim 1, wherein the stay comprises a type, color, and/or pattern of fabric that is different from the type, color, and/or pattern of fabric of the front section and/or strap of the garment.

41. The garment of claim 1, wherein the stay comprises a type, color, and/or pattern of fabric that is the same as the type, color, and/or pattern of fabric of the front section and/or strap of the garment.

42. The garment of claim 1, wherein said garment further comprises an underarm side panel on a left and right side of the garment.

43. The garment of claim 1, wherein the first lower end of each said stay is attached at a point along a portion of the inside surface of the front band that is configured to be positioned at or near a center point below a breast of a wearer.

44. The garment of claim 3, wherein each strap is connected at the second end to an X-shaped piece of fabric that is attached to the back section of the garment.

45. The garment of claim 3, wherein the garment comprises said single strap having first and second ends each of which is connected to a top of a respective cup or to the top edge of the front section of the garment, and wherein the strap does not connect to the back section of the garment.

46. The garment of claim 1, wherein the garment does not comprise metal components.

47. The garment of claim 1, wherein the garment does not comprise plastic components.

48. The garment of claim 1, wherein the garment does not comprise a front closure and/or a back closure.

* * * * *